US008814511B2

(12) United States Patent
Check et al.

(10) Patent No.: US 8,814,511 B2
(45) Date of Patent: Aug. 26, 2014

(54) TURBOMACHINE COMPONENT HAVING AN AIRFOIL CORE SHAPE

(75) Inventors: Benjamin Michael Check, Greenville, SC (US); Craig Allen Bielek, Greenville, SC (US); Hal Feaster Pollard, Greenville, SC (US); Sivaraman Vedhagiri, Greer, SC (US)

(73) Assignee: General Electric Company, Schenectady, NY (US)

( * ) Notice: Subject to any disclaimer, the term of this patent is extended or adjusted under 35 U.S.C. 154(b) by 586 days.

(21) Appl. No.: 13/206,016

(22) Filed: Aug. 9, 2011

(65) Prior Publication Data

US 2013/0039771 A1 Feb. 14, 2013

(51) Int. Cl.
*F01D 9/02* (2006.01)

(52) U.S. Cl.
USPC ..... 415/191; 415/210.1

(58) Field of Classification Search
USPC ..... 415/193, 191, 208.2, 209.1–209.4, 415/210.1, 211.2
See application file for complete search history.

(56) References Cited

U.S. PATENT DOCUMENTS

| | | | | |
|---|---|---|---|---|
| 6,461,109 | B1 | 10/2002 | Wedlake et al. | |
| 6,866,477 | B2 | 3/2005 | Arness et al. | |
| 6,887,041 | B2 | 5/2005 | Coke et al. | |
| 8,070,428 | B2 * | 12/2011 | Bielek et al. | 415/191 |
| 2004/0175271 | A1 | 9/2004 | Coke et al. | |
| 2005/0025618 | A1 | 2/2005 | Arness et al. | |

FOREIGN PATENT DOCUMENTS

| | | | |
|---|---|---|---|
| EP | 1455053 | A2 | 9/2004 |
| EP | 1503037 | A2 | 2/2005 |
| WO | 03006798 | A1 | 1/2003 |

* cited by examiner

*Primary Examiner* — Edward Look
*Assistant Examiner* — Jesse Prager
(74) *Attorney, Agent, or Firm* — Cantor Colburn LLP

(57) ABSTRACT

A turbomachine component includes a turbine stator nozzle member having an airfoil core shape. The airfoil core shape includes a nominal profile substantially in accordance with Cartesian coordinate values of X, Y, and Z set forth in TABLE 1, and wherein X and Y are distances in inches which, when connected by smooth continuing arcs, define airfoil profile sections at each distance Z in inches, the profile sections at the Z distances being joined smoothly with one another to form a complete airfoil core shape.

10 Claims, 4 Drawing Sheets

TURBOMACHINE COMPONENT HAVING AN AIRFOIL CORE SHAPE

BACKGROUND OF THE INVENTION

The subject matter disclosed herein relates to the art of turbomachines and, more particularly, to a turbomachine component having an airfoil core shape.

Many system requirements must be met for each stage of a turbomachine in order to meet design goals including an overall improvement in system efficiency. In particular, third stage nozzles must meet system requirements including airfoil loading and manufacturability. These third stage nozzles must operate within a particular set of boundary conditions based on operating conditions of the turbomachine while maintaining a shape that meets design specifications.

BRIEF DESCRIPTION OF THE INVENTION

According to one aspect of the exemplary embodiment, a turbomachine component includes a turbine stator nozzle member having an airfoil core shape. The airfoil core shape includes a nominal profile substantially in accordance with Cartesian coordinate values of X, Y, and Z set forth in TABLE 1, and wherein X and Y are distances in inches which, when connected by smooth continuing arcs, define airfoil profile sections at each distance Z in inches, the profile sections at the Z distances being joined smoothly with one another to form a complete airfoil core shape.

According to another aspect of the exemplary embodiment, a turbomachine includes a turbine portion, and a turbine stator nozzle member provided in the turbine portion. The turbine stator nozzle member includes an airfoil core shape. The airfoil core shape includes a nominal profile substantially in accordance with Cartesian coordinate values of X, Y, and Z set forth in TABLE 1, and wherein X and Y are distances in inches which, when connected by smooth continuing arcs, define airfoil profile sections at each distance Z in inches, the profile sections at the Z distances being joined smoothly with one another to form a complete airfoil core shape.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
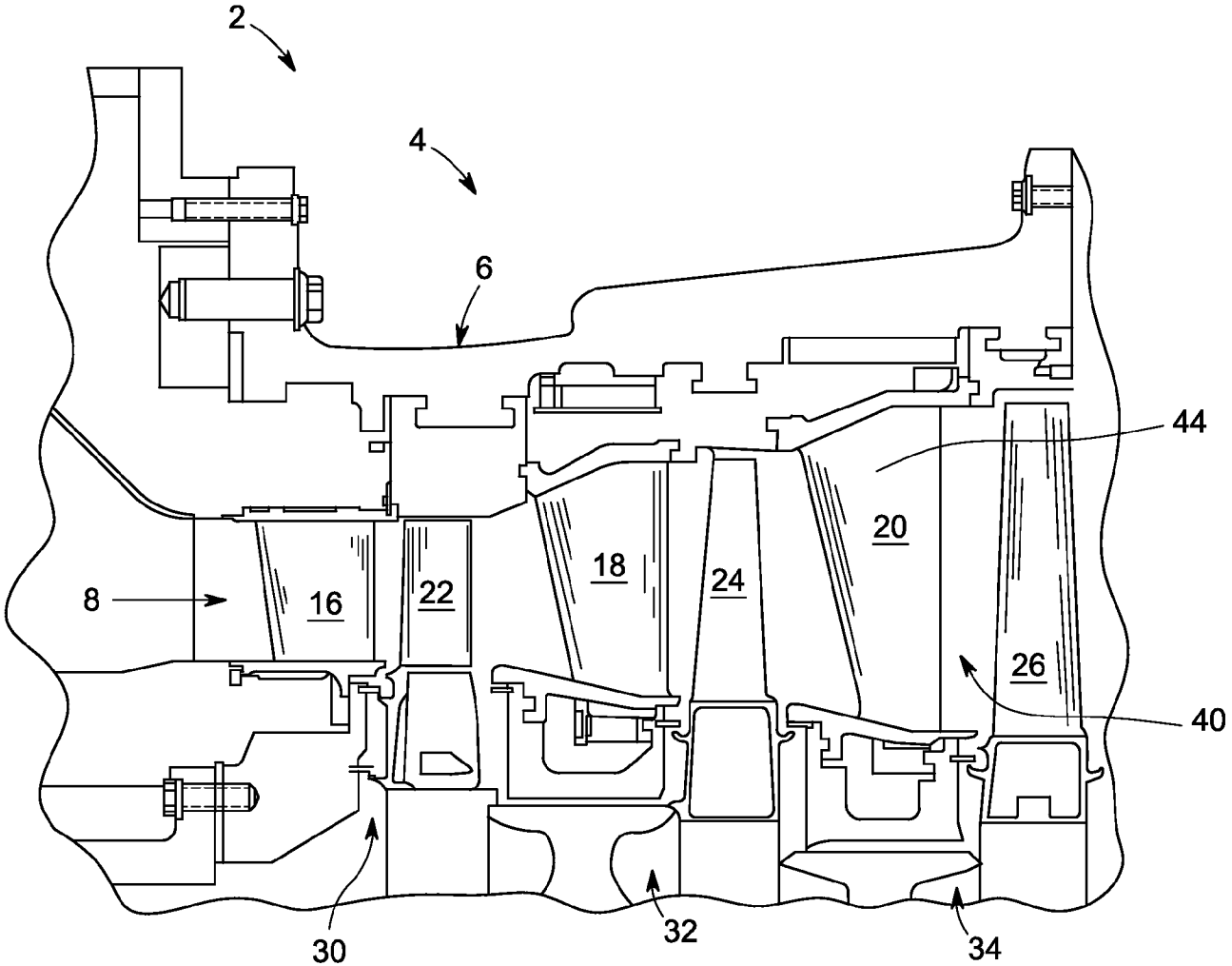
FIG. 1 is a partial cross-sectional view of a turbomachine including a nozzle assembly having an airfoil core shape in accordance with an exemplary embodiment

As shown in FIG. 1, a turbomachine 2, constructed in accordance with an exemplary embodiment, includes a compressor portion (not shown) and a turbine portion 4. Turbine portion 4 is enclosed by a turbine housing 6 and has an axial flow path 8. Turbine portion 4 includes a plurality of nozzle assemblies 16, 18, and 20. Each nozzle assembly 16, 18, and 20 is positioned upstream of a corresponding rotor blade assembly 22, 24, and 26. Nozzle assembly 16 and rotor assembly 22 combine to establish a first turbine stage 30; nozzle assembly 18 and rotor assembly 24 combine to form a second turbine stage 32; and nozzle assembly 20 and rotor assembly 26 combine to form a second turbine stage 34. Of course it should be understood that each of the first, second and third turbine stages 30, 32, and 34 include additional nozzle and rotor assemblies. It should be also understood that turbine portion 4 includes additional turbine stages that collectively establish, for example, a 9FB PP2 gas turbine frame.

Figure 2:
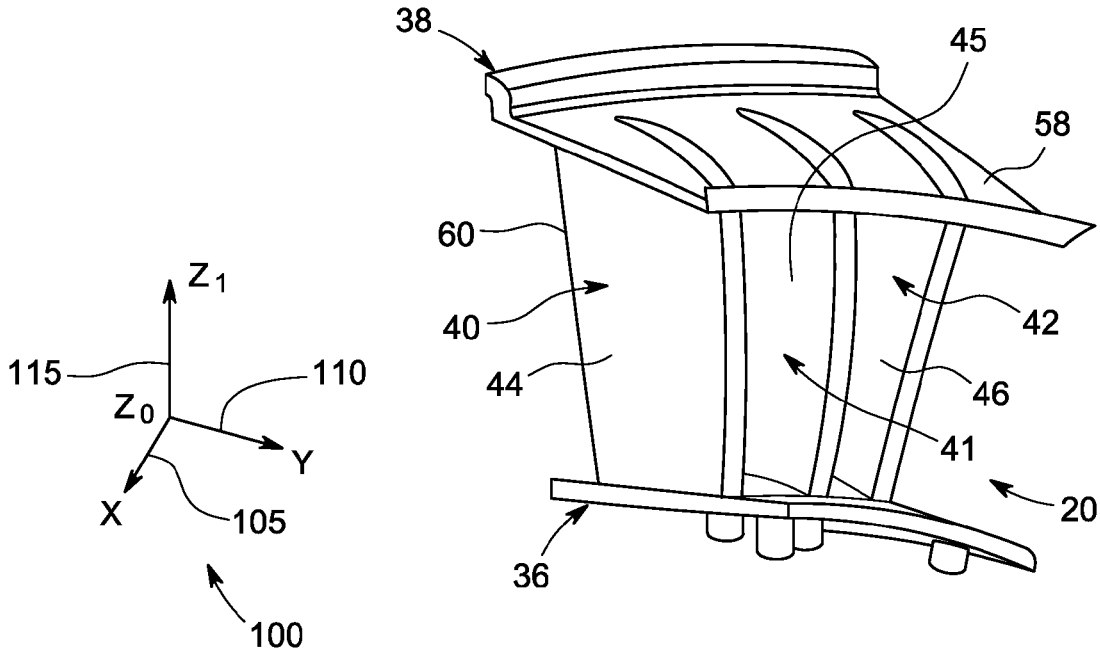
FIG. 2 is a perspective view of a nozzle assembly FIG. 1.

As best shown in FIG. 2, third turbine stage nozzle assembly 20 includes a base portion 36 and a tip or shroud portion 38 between which extends a plurality of third stage nozzle members 40-42 each having an associated airfoil core shape 44-46. As each nozzle member 40-42 is similarly formed, and includes substantially similar airfoil core shapes 44-46 a detailed description will follow with reference to FIGS. 3 and 4 in describing third stage nozzle member 40 and airfoil core shape 44 with an understanding that nozzle members 41-42 and associated airfoil core shapes 45-46 include corresponding structure/design. Third stage nozzle member 40 includes a first end 50 that extends to a second end 52 through an airfoil portion 54 that is defined by airfoil core shape 44. Third stage nozzle member 40 also includes a leading edge 58 and a trailing edge 60 between which extend a suction side 62 and a pressure side 64.

Airfoil core shape 44 in accordance with an exemplary embodiment is configured for enhanced turbine performance. A list of X, Y, and Z coordinates or points for airfoil core shape 44 is presented in TABLE 1, and meets requirements for interaction between adjacent stages, aerodynamic efficiency and provides an improved aeromechanics margin over prior shapes. Moreover, the particular airfoil core shape 44 in accordance with the exemplary embodiment meets system requirements for flow dynamics, loading, and frequency response. The points are arrived at by iteration between aerodynamic and mechanical design improvements and are the only loci of points that allow turbomachine 2 to operate in an efficient, smooth manner. As will become more fully evident below, airfoil core shape 44 is represented as a set of 1920 points listed in TABLE 1. The 1920 points represent 15 airfoil sections. The X, Y, and Z coordinates, which represent a profile of airfoil core shape 44, are created in a coordinate system which is defined relative to a cold engine part. The origin of the coordinate system on the cold centerline axis is X=0.0, Y=0.0 and Z=0.0. The Z coordinate axis is defined as a radial line from the Y coordinate axis; the X coordinate axis is defined as being normal to a plane defined by the Y-Z axis. The airfoil sections are cut normal to the Z coordinate axis. X and Y points, which make up the airfoil core profile shape 44 at each section, are in inches. The radial Z values in inches for the section planes have an origin of $Z_0$.

The radial distance between each section varies however a total radial distance of airfoil core shape 44 is 15.0 inches.

The bottom and top sections $Z_0$ and $Z_1$, may be obscured by cast-in features that are not included in the X, Y, and Z points that define airfoil core shape 44. All of the 1920 points are taken from a nominal cold or room temperature for each airfoil section of airfoil core shape 44. Each airfoil section is joined smoothly with adjacent airfoil sections to form the airfoil core shape 44.

It should be appreciated that as nozzle assembly 20 heats up during operation of turbine portion 4, airfoil core shape 44 may change as a result of stress and temperature. Thus, the X, Y and Z points are provided at cold or room temperature for manufacturing purposes. Since the manufactured airfoil core shape may be different from a nominal airfoil core shape defined in Table 1, a tolerance of ±0.100 inches from the nominal profile is allowed and thus defines an overall design envelope for airfoil core shape 44. The overall design is robust to this design envelope without impairment of mechanical or aerodynamic properties of third turbine stage 34.

It should also be appreciated that the airfoil core shape 44 can be scaled up or scaled down geometrically for introductions into similar turbine designs, with smaller or larger frame sizes. Consequently, the X, Y, and Z coordinates in inches may be multiplied or divided by the same constant or number/factor to provide a scaled up or scaled down version of third stage nozzle 40 while retaining the airfoil core profile shape and unique properties.

As best shown in FIG. 2, a coordinate system for airfoil core shape 44 in accordance with exemplary embodiment is indicated generally at 100. As discussed above, coordinate system 100 is defined relative to a cold nozzle. Coordinate system 100 includes an X-axis 105, a Y-axis 110, and a Z-axis 115. The origin of coordinate system 100 is centered at first end 50 of nozzle member 40. X-axis 105 is directed axially along a centerline axis (not separately labeled) of turbomachine 2 and Z-axis 115 is directed along a radial line normal to the centerline axis. The positive direction of X-axis 105, Y-axis 110, and Z-axis 115 is identified by label placement in FIG. 2.

Figure 3:
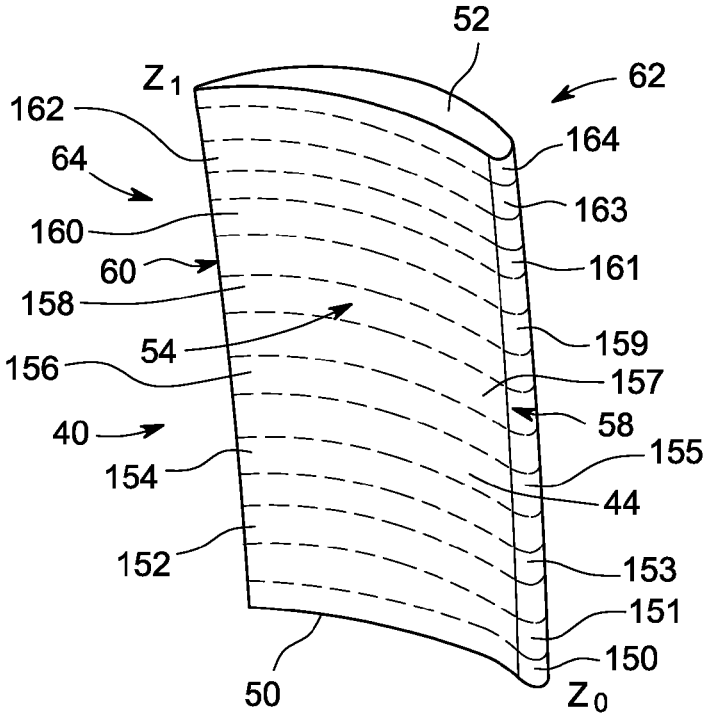
FIG. 3 is a perspective view of a nozzle member of the nozzle assembly of FIG. 2 illustrating the airfoil core shape defined at a plurality of sections.
Figure 4:
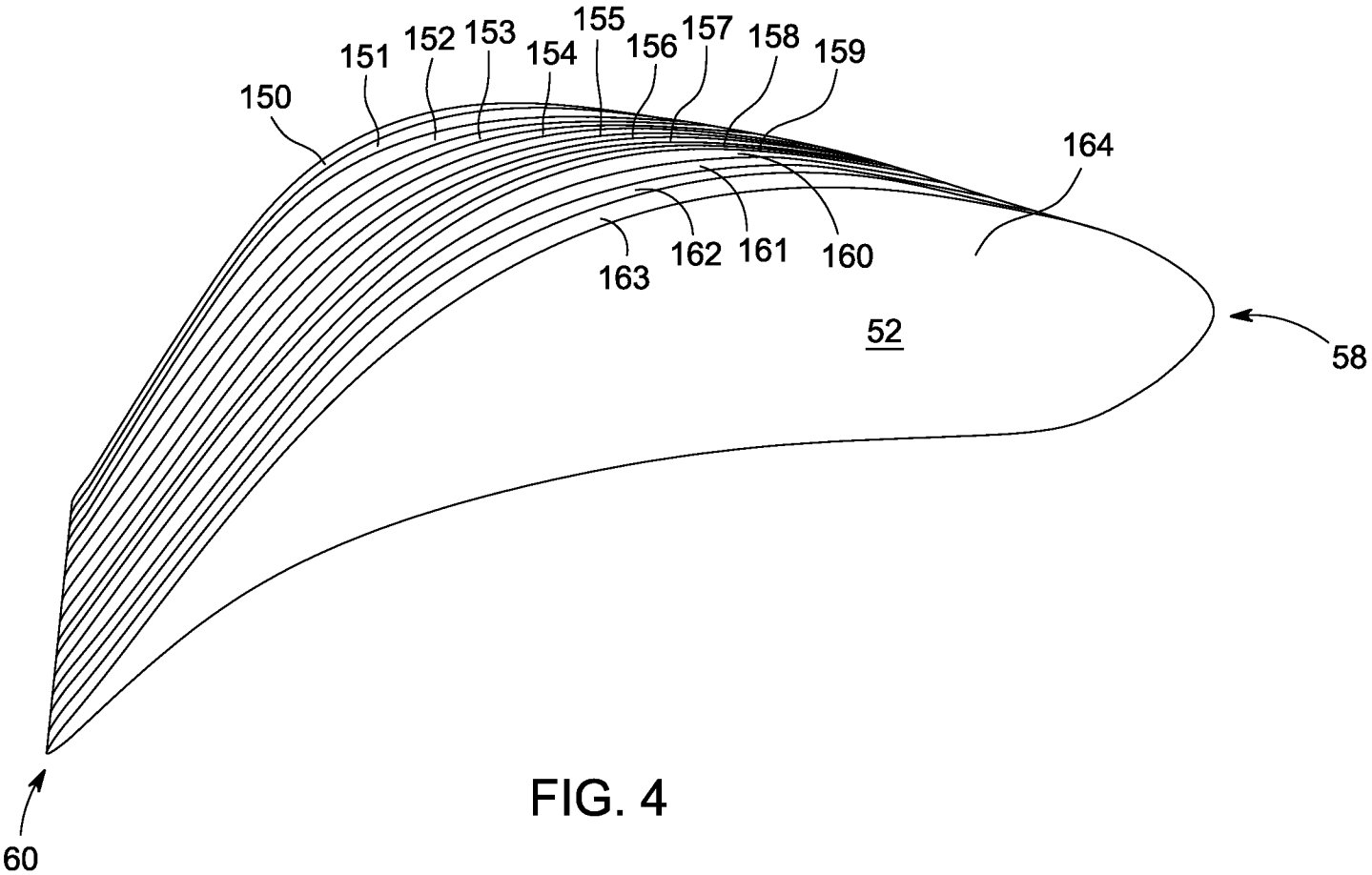
FIG. 4 is another perspective view of the nozzle member of the nozzle assembly of FIG. 3.
Figure 5:
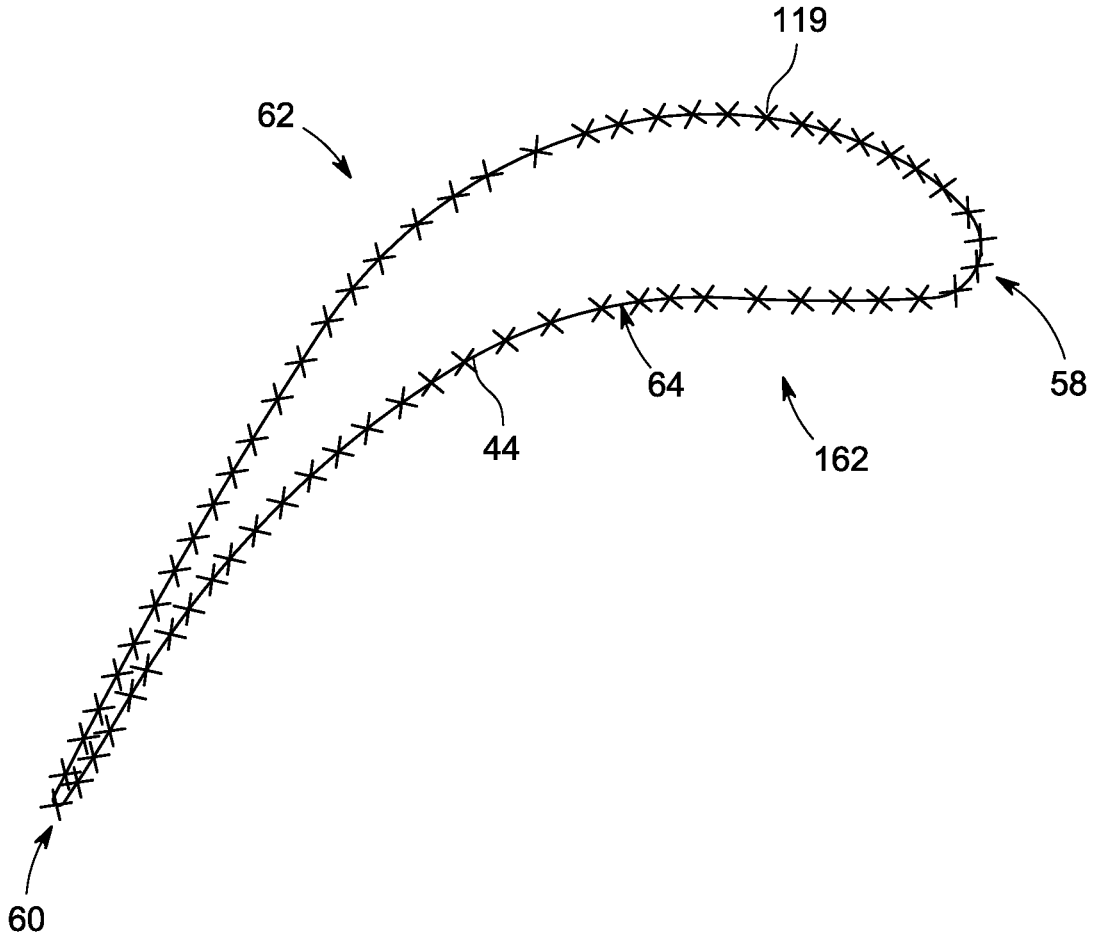
FIG. 5 is a cross-sectional view of the nozzle member of FIG. 3 taken at one of the plurality of sections.

As best shown in FIGS. 3-5, airfoil core shape 44 includes a plurality of sections 150-164. Section 150 is located at $Z_0$ and the airfoil core shape 44 extends through sections 163 before terminating at section 164 located at $Z_1$. As discussed above, sections 150-164 are cut normal to $Z_c$-axis 115. The X and Y coordinates which make up each section are presented in Table 1 are in inches.

Figure 6:
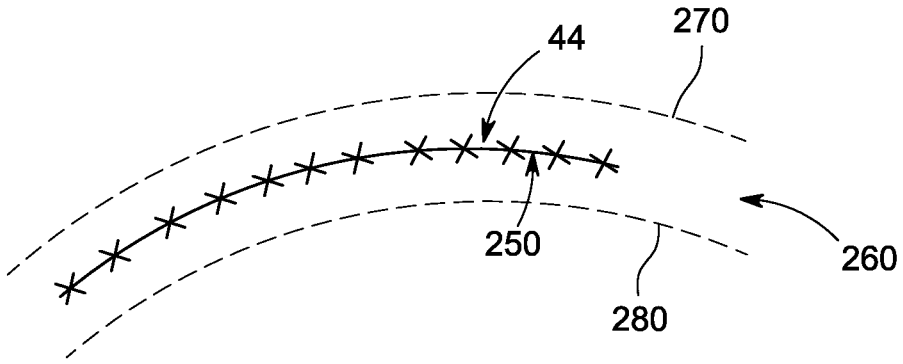
FIG. 6 is a partial plan view of the one of the plurality of sections in FIG. 4 indicating a design envelope of the airfoil core shape in accordance with an aspect of the exemplary embodiment.

FIG. 6 illustrates a design envelope for airfoil core shape 44. The X, Y, and Z values listed in TABLE 1 illustrate ideal point location for each point of each section of airfoil core shape 44. However, there exist variations from the ideal point location attributed to manufacturing tolerances and the like which must be taken into account. Thus, a design envelope is established which sets forth an acceptable outer boundary or distance from a nominal profile 250 for each section 150-165. Therefore it should be understood that each X, Y, and Z point includes a tolerance or ±value. In consideration of process capability, a tolerance 260 of ±0.100 inches is allowed in the formation of airfoil core shape 30. Tolerance 260 includes an upper limit 270 defined as a 0.100-inch deviation from nominal profile 250 and a lower limit 280, defined as a −0.100-inch variation from nominal profile 250. The design envelope or tolerance 260 is robust such that this variation does not impair mechanical and aerodynamic performance of third stage nozzle member 40.

In no way limiting of the exemplary embodiment, airfoil core shape 44 provides an increased efficiency as compared to previous individual airfoil core shapes for third stage nozzle member 40. Moreover, and in no way limiting of the exemplary embodiment, in conjunction with other airfoil core shapes, which are conventional or enhanced (similar to the enhancements herein), airfoil core shape 44, as embodied by the invention, provides an increased efficiency as compared to previous individual sets of airfoil core shapes for third stage nozzle member 40. This increased efficiency provides, in addition to the above-noted advantages, a power output with a decrease the required fuel, therefore inherently decreasing emissions to produce energy. Of course, other such advantages are within the scope of the exemplary embodiment.

TABLE 1

| Section 1 | | | Section 2 | | | Section 3 | | | Section 4 | | |
|---|---|---|---|---|---|---|---|---|---|---|---|
| X | Y | Z | X | Y | Z | X | Y | Z | X | Y | Z |
| 0.624 | −0.3966 | 60.864 | 0.493 | −0.2812 | 59.864 | 0.3094 | −0.0617 | 58.864 | 0.3745 | −0.1484 | 57.864 |
| 0.2077 | −0.0357 | 60.864 | 0.7264 | −0.4304 | 59.864 | 0.6313 | −0.3378 | 58.864 | 0.6855 | −0.3418 | 57.864 |
| 1.903 | −1.3094 | 60.864 | 2.5861 | −1.2323 | 59.864 | 0.6939 | −0.2092 | 58.864 | 0.42 | −0.0559 | 57.864 |
| 2.0022 | −0.9341 | 60.864 | 0.258 | −0.1345 | 59.864 | 0.398 | −0.0649 | 58.864 | 1.3701 | −0.7919 | 57.864 |
| 0.2649 | −0.0423 | 60.864 | 0.3581 | −0.0666 | 59.864 | 2.6118 | −1.2222 | 58.864 | 0.3584 | −0.129 | 57.864 |
| 1.0422 | −0.674 | 60.864 | 1.9419 | −1.2921 | 59.864 | 0.3438 | −0.0463 | 58.864 | 1.0772 | −0.5947 | 57.864 |
| 0.1807 | −0.0637 | 60.864 | 0.2665 | −0.0431 | 59.864 | 0.3251 | −0.0507 | 58.864 | 0.4773 | −0.2118 | 57.864 |
| 2.3312 | −1.6755 | 60.864 | 0.2456 | −0.1223 | 59.864 | 1.6169 | −1.0039 | 58.864 | 0.4011 | −0.0541 | 57.864 |
| 0.8719 | −0.3432 | 60.864 | 1.7222 | −1.1221 | 59.864 | 0.5055 | −0.2586 | 58.864 | 0.4376 | −0.0631 | 57.864 |
| 0.4126 | −0.2613 | 60.864 | 1.481 | −0.6325 | 59.864 | 2.0694 | −0.9224 | 58.864 | 1.6591 | −0.9949 | 57.864 |
| 0.227 | −0.0312 | 60.864 | 0.3229 | −0.0493 | 59.864 | 0.4155 | −0.0733 | 58.864 | 0.3828 | −0.0589 | 57.864 |
| 1.6816 | −1.1352 | 60.864 | 0.2397 | −0.0707 | 59.864 | 2.6081 | −1.8048 | 58.864 | 2.2157 | −1.4149 | 57.864 |
| 0.1764 | −0.0829 | 60.864 | 2.5737 | −1.8349 | 59.864 | 0.2987 | −0.0778 | 58.864 | 0.4433 | −0.1904 | 57.864 |
| 0.1791 | −0.1002 | 60.864 | 0.6404 | −0.2049 | 59.864 | 1.9041 | −1.2185 | 58.864 | 0.3531 | −0.1044 | 57.864 |
| 2.5603 | −1.2428 | 60.864 | 0.2855 | −0.0387 | 59.864 | 1.0281 | −0.5953 | 58.864 | 0.5116 | −0.2331 | 57.864 |
| 0.2827 | −0.0512 | 60.864 | 1.0896 | −0.6706 | 59.864 | 0.3794 | −0.1798 | 58.864 | 0.3573 | −0.0859 | 57.864 |
| 0.834 | −0.534 | 60.864 | 0.2378 | −0.1067 | 59.864 | 1.5225 | −0.6308 | 58.864 | 2.637 | −1.2112 | 57.864 |
| 2.1197 | −1.4893 | 60.864 | 0.3756 | −0.2076 | 59.864 | 2.1441 | −1.4075 | 58.864 | 1.0199 | −0.3496 | 57.864 |
| 0.1873 | −0.1159 | 60.864 | 2.3682 | −1.6481 | 59.864 | 0.3807 | −0.0563 | 58.864 | 0.3676 | −0.07 | 57.864 |
| 1.4392 | −0.6346 | 60.864 | 2.0359 | −0.9281 | 59.864 | 0.3159 | −0.1411 | 58.864 | 2.1021 | −0.9163 | 57.864 |
| 0.2001 | −0.128 | 60.864 | 0.3404 | −0.0581 | 59.864 | 0.5685 | −0.298 | 58.864 | 0.472 | −0.0798 | 57.864 |
| 0.2466 | −0.0343 | 60.864 | 0.2505 | −0.0544 | 59.864 | 0.2965 | −0.1134 | 58.864 | 0.7465 | −0.2135 | 57.864 |
| 1.3651 | −0.9001 | 60.864 | 0.6099 | −0.3555 | 59.864 | 0.304 | −0.1288 | 58.864 | 2.4818 | −1.633 | 57.864 |
| 0.1916 | −0.0471 | 60.864 | 0.9217 | −0.3452 | 59.864 | 0.2943 | −0.0965 | 58.864 | 0.4547 | −0.0715 | 57.864 |
| 2.5367 | −1.868 | 60.864 | 0.3048 | −0.0415 | 59.864 | 0.9713 | −0.3474 | 58.864 | 0.4087 | −0.1697 | 57.864 |
| 3.1125 | −1.5619 | 60.864 | 0.2354 | −0.0896 | 59.864 | 1.3247 | −0.7964 | 58.864 | 1.5631 | −0.629 | 57.864 |
| 0.3005 | −0.0599 | 60.864 | 1.4088 | −0.8922 | 59.864 | 0.4423 | −0.2193 | 58.864 | 1.9437 | −1.2043 | 57.864 |

TABLE 1-continued

| | | | | | | | | | | | |
|---|---|---|---|---|---|---|---|---|---|---|---|
| 2.9284 | −2.2726 | 60.864 | 2.1574 | −1.4673 | 59.864 | 0.3629 | −0.0487 | 58.864 | 4.5333 | −4.0976 | 57.864 |
| 5.1631 | −2.9798 | 60.864 | 5.5353 | −3.257 | 59.864 | 2.379 | −1.6028 | 58.864 | 4.148 | −2.1138 | 57.864 |
| 3.7788 | −3.3862 | 60.864 | 4.3769 | −2.336 | 59.864 | 4.0043 | −3.4168 | 58.864 | 3.4973 | −1.7093 | 57.864 |
| 3.9304 | −2.0686 | 60.864 | 3.7661 | −3.2141 | 59.864 | 3.0463 | −2.2301 | 58.864 | 4.0546 | −3.3325 | 57.864 |
| 3.2916 | −2.7027 | 60.864 | 3.3948 | −2.7182 | 59.864 | 4.9583 | −2.7193 | 58.864 | 4.2235 | −3.5816 | 57.864 |
| 4.7175 | −2.6212 | 60.864 | 4.3987 | −4.2782 | 59.864 | 4.4728 | −4.2035 | 58.864 | 5.612 | −3.2054 | 57.864 |
| 4.0631 | −3.8603 | 60.864 | 5.1633 | −2.9295 | 59.864 | 3.6462 | −2.9221 | 58.864 | 3.2343 | −2.3383 | 57.864 |
| 3.3876 | −1.7268 | 60.864 | 3.1961 | −2.4806 | 59.864 | 5.6137 | −3.2681 | 58.864 | 4.7145 | −2.497 | 57.864 |
| 2.736 | −2.067 | 60.864 | 3.7614 | −1.9297 | 59.864 | 3.1493 | −1.5309 | 58.864 | 2.9919 | −2.0941 | 57.864 |
| 5.3516 | −3.1461 | 60.864 | 4.2545 | −4.0041 | 59.864 | 5.1981 | −2.9083 | 58.864 | 4.4672 | −2.3254 | 57.864 |
| 3.6256 | −3.1559 | 60.864 | 3.9383 | −3.4717 | 59.864 | 4.1697 | −3.6734 | 58.864 | 3.1673 | −1.5144 | 57.864 |
| 4.197 | −2.2468 | 60.864 | 3.5849 | −2.9629 | 59.864 | 3.2542 | −2.4537 | 58.864 | 4.3831 | −3.8368 | 57.864 |
| 4.3544 | −4.425 | 60.864 | 4.677 | −2.5504 | 59.864 | 4.1417 | −2.1434 | 58.864 | 3.4673 | −2.5914 | 57.864 |
| 3.1136 | −2.4846 | 60.864 | 3.131 | −1.5463 | 59.864 | 5.4319 | −3.1049 | 58.864 | 4.958 | −2.674 | 57.864 |
| 4.9699 | −2.819 | 60.864 | 5.3517 | −3.0905 | 59.864 | 3.8145 | −1.9335 | 58.864 | 3.8767 | −3.0897 | 57.864 |
| 3.9246 | −3.6211 | 60.864 | 2.9889 | −2.2503 | 59.864 | 3.8297 | −3.1663 | 58.864 | 2.7408 | −1.8592 | 57.864 |
| 3.6605 | −1.8955 | 60.864 | 4.0714 | −2.1295 | 59.864 | 2.8307 | −2.0137 | 58.864 | 5.4302 | −3.0475 | 57.864 |
| 5.5348 | −3.3182 | 60.864 | 4.9705 | −2.7737 | 59.864 | 3.4834 | −1.7297 | 58.864 | 3.8244 | −1.9087 | 57.864 |
| 3.4623 | −2.9266 | 60.864 | 4.101 | −3.7351 | 59.864 | 4.3259 | −3.9358 | 58.864 | 3.6903 | −2.8534 | 57.864 |
| 4.4596 | −2.4307 | 60.864 | 2.7734 | −2.0277 | 59.864 | 4.7132 | −2.5369 | 58.864 | 5.1969 | −2.8572 | 57.864 |
| 4.1945 | −4.1036 | 60.864 | 3.4476 | −1.7356 | 59.864 | 3.4543 | −2.6845 | 58.864 | 6.5692 | −4.272 | 57.864 |
| 6.7854 | −4.9958 | 60.864 | 7.2502 | −6.0195 | 59.864 | 4.464 | −2.3605 | 58.864 | 6.1251 | −3.7137 | 57.864 |
| 6.0561 | −3.8834 | 60.864 | 5.2305 | −6.622 | 59.864 | 6.8133 | −4.7778 | 58.864 | 6.8203 | −4.6726 | 57.864 |
| 4.5027 | −4.7521 | 60.864 | 5.0734 | −6.0075 | 59.864 | 5.2698 | −6.3382 | 58.864 | 7.1139 | −5.2898 | 57.864 |
| 5.0779 | −6.4512 | 60.864 | 4.6596 | −4.8401 | 59.864 | 6.6936 | −4.5699 | 58.864 | 5.5261 | −7.321 | 57.864 |
| 7.0808 | −5.6746 | 60.864 | 6.7999 | −4.8864 | 59.864 | 4.7383 | −4.7535 | 58.864 | 7.3221 | −5.9411 | 57.864 |
| 6.5228 | −4.532 | 60.864 | 6.0604 | −3.8036 | 59.864 | 6.5646 | −4.3676 | 58.864 | 6.9276 | −4.8738 | 57.864 |
| 5.7121 | −3.4964 | 60.864 | 5.2968 | −6.9397 | 59.864 | 7.184 | −5.6245 | 58.864 | 5.3364 | −6.1937 | 57.864 |
| 4.7655 | −5.4205 | 60.864 | 5.1547 | −6.3065 | 59.864 | 5.9606 | −3.612 | 58.864 | 7.2623 | −5.721 | 57.864 |
| 5.2466 | −7.223 | 60.864 | 7.0983 | −5.5523 | 59.864 | 5.4596 | −7.3652 | 58.864 | 6.2829 | −3.8956 | 57.864 |
| 6.893 | −5.218 | 60.864 | 6.5335 | −4.4335 | 59.864 | 7.017 | −5.193 | 58.864 | 5.2531 | −5.8671 | 57.864 |
| 6.2209 | −4.0928 | 60.864 | 5.7134 | −3.4292 | 59.864 | 5.0872 | −5.679 | 58.864 | 5.7889 | −3.3688 | 57.864 |
| 4.9845 | −6.1045 | 60.864 | 4.9832 | −5.7111 | 59.864 | 6.2809 | −3.9807 | 58.864 | 5.9602 | −3.5381 | 57.864 |
| 7.1607 | −5.9083 | 60.864 | 4.8843 | −5.4175 | 59.864 | 5.3444 | −6.6783 | 58.864 | 5.3968 | −6.4731 | 57.864 |
| 6.6592 | −4.761 | 60.864 | 6.9088 | −5.104 | 59.864 | 4.8567 | −5.035 | 58.864 | 4.8043 | −4.6352 | 57.864 |
| 5.8828 | −3.6808 | 60.864 | 6.2272 | −4.0066 | 59.864 | 7.2535 | −5.8452 | 58.864 | 5.4481 | −6.7544 | 57.864 |
| 4.6396 | −5.0841 | 60.864 | 7.1785 | −5.7822 | 59.864 | 6.1244 | −3.7932 | 58.864 | 5.0472 | −5.2252 | 57.864 |
| 5.1684 | −6.8358 | 60.864 | 6.6719 | −4.6569 | 59.864 | 6.9197 | −4.9832 | 58.864 | 4.6738 | −4.3639 | 57.864 |
| 6.9915 | −5.4444 | 60.864 | 5.8853 | −3.6076 | 59.864 | 5.1845 | −6.007 | 58.864 | 5.491 | −7.0371 | 57.864 |
| 6.3766 | −4.3091 | 60.864 | 4.7764 | −5.1271 | 59.864 | 4.6103 | −4.4762 | 58.864 | 6.6995 | −4.4694 | 57.864 |
| 4.8804 | −5.7607 | 60.864 | 5.3544 | −7.2592 | 59.864 | 5.7901 | −3.437 | 58.864 | 5.1567 | −5.544 | 57.864 |
| 5.3137 | −7.6124 | 60.864 | 7.0083 | −5.3262 | 59.864 | 5.4073 | −7.0208 | 58.864 | 4.9247 | −4.9111 | 57.864 |
| 6.6286 | −10.3829 | 60.864 | 4.5337 | −4.557 | 59.864 | 7.1051 | −5.4069 | 58.864 | 7.0255 | −5.0797 | 57.864 |
| 5.5047 | −9.0275 | 60.864 | 6.3851 | −4.2166 | 59.864 | 4.9779 | −5.3549 | 58.864 | 7.1929 | −5.5037 | 57.864 |
| 6.9085 | −10.0286 | 60.864 | 5.7522 | −9.8737 | 59.864 | 6.4269 | −4.1711 | 58.864 | 6.4302 | −4.0807 | 57.864 |
| 5.6804 | −9.858 | 60.864 | 6.3168 | −10.326 | 59.864 | 7.2331 | −8.8735 | 58.864 | 6.1553 | −9.9265 | 57.864 |
| 7.2356 | −9.2557 | 60.864 | 6.9525 | −9.7267 | 59.864 | 6.8731 | −9.633 | 58.864 | 6.7816 | −9.5344 | 57.864 |
| 5.912 | −10.3033 | 60.864 | 6.6954 | −10.0912 | 59.864 | 5.5364 | −8.0578 | 58.864 | 7.4709 | −7.0039 | 57.864 |
| 7.4341 | −8.141 | 60.864 | 7.0345 | −9.5703 | 59.864 | 7.4485 | −7.8404 | 58.864 | 5.8126 | −9.693 | 57.864 |
| 6.1871 | −10.5054 | 60.864 | 7.1728 | −9.2456 | 59.864 | 6.5495 | −10.0015 | 58.864 | 5.5964 | −8.2936 | 57.864 |
| 7.3866 | −6.8872 | 60.864 | 7.1078 | −9.4098 | 59.864 | 7.4312 | −6.7121 | 58.864 | 7.3783 | −8.1376 | 57.864 |
| 6.4588 | −10.4953 | 60.864 | 5.7963 | −9.9688 | 59.864 | 6.2386 | −10.129 | 58.864 | 5.9116 | −9.8086 | 57.864 |
| 5.4227 | −8.3951 | 60.864 | 6.7467 | −10.0323 | 59.864 | 5.9339 | −9.9957 | 58.864 | 7.0839 | −9.0333 | 57.864 |
| 6.7242 | −10.2862 | 60.864 | 5.404 | −7.58 | 59.864 | 5.7159 | −9.6124 | 58.864 | 7.4081 | −6.3624 | 57.864 |
| 5.575 | −9.4466 | 60.864 | 5.4467 | −7.9019 | 59.864 | 7.1015 | −9.2124 | 58.864 | 7.4379 | −6.5753 | 57.864 |
| 7.0489 | −9.759 | 60.864 | 7.4601 | −7.4877 | 59.864 | 5.6146 | −9.0254 | 58.864 | 6.0956 | −9.9144 | 57.864 |
| 5.7582 | −10.0555 | 60.864 | 6.8215 | −9.9348 | 59.864 | 7.3339 | −8.5242 | 58.864 | 6.9118 | −9.3472 | 57.864 |
| 7.3361 | −8.8544 | 60.864 | 7.4328 | −6.9929 | 59.864 | 6.7355 | −9.8189 | 58.864 | 5.615 | −8.6964 | 57.864 |
| 6.0264 | −10.4139 | 60.864 | 6.6406 | −10.147 | 59.864 | 7.4707 | −7.3783 | 58.864 | 7.3263 | −8.3596 | 57.864 |
| 7.4474 | −7.6385 | 60.864 | 5.6373 | −9.4718 | 59.864 | 6.427 | −10.0798 | 58.864 | 5.7129 | −9.4686 | 57.864 |
| 6.2898 | −10.529 | 60.864 | 7.403 | −6.7468 | 59.864 | 7.3613 | −6.2815 | 58.864 | 6.7091 | −9.6223 | 57.864 |
| 7.2939 | −6.393 | 60.864 | 6.0769 | −10.2721 | 59.864 | 6.1174 | −10.1084 | 58.864 | 7.4188 | −7.9132 | 57.864 |
| 6.5757 | −10.4259 | 60.864 | 6.5186 | −10.2451 | 59.864 | 5.834 | −9.8778 | 58.864 | 7.4481 | −7.6872 | 57.864 |
| 5.4758 | −8.817 | 60.864 | 5.951 | −10.1789 | 59.864 | 5.6701 | −9.4238 | 58.864 | 5.7721 | −9.6218 | 57.864 |
| 6.8416 | −10.1339 | 60.864 | 5.4836 | −8.2246 | 59.864 | 6.9344 | −9.5349 | 58.864 | 6.5782 | −9.7537 | 57.864 |
| 5.649 | −9.7565 | 60.864 | 7.4572 | −7.7356 | 59.864 | 5.5687 | −8.4656 | 58.864 | 5.5539 | −7.6058 | 57.864 |
| 7.1812 | −9.4264 | 60.864 | 6.4507 | −10.284 | 59.864 | 7.4214 | −8.0701 | 58.864 | 6.3357 | −9.9036 | 57.864 |
| 5.8633 | −10.2401 | 60.864 | 5.8972 | −10.1216 | 59.864 | 6.6053 | −9.9548 | 58.864 | 5.7393 | −9.5465 | 57.864 |
| 7.4107 | −8.3912 | 60.864 | 5.5265 | −8.6416 | 59.864 | 7.4532 | −6.9292 | 58.864 | 7.1564 | −8.8695 | 57.864 |
| 6.1385 | −10.4843 | 60.864 | 6.2544 | −10.3284 | 59.864 | 6.3001 | −10.1232 | 58.864 | 5.5752 | −7.8911 | 57.864 |
| 7.4174 | −7.1367 | 60.864 | 6.5818 | −10.1987 | 59.864 | 5.9941 | −10.0444 | 58.864 | 6.4637 | −9.84 | 57.864 |
| 6.3949 | −10.5176 | 60.864 | 5.6851 | −9.6756 | 59.864 | 5.7471 | −9.7044 | 58.864 | 5.6499 | −9.1466 | 57.864 |
| 5.3714 | −8.0033 | 60.864 | 7.4519 | −7.24 | 59.864 | 7.1714 | −9.0446 | 58.864 | 7.4738 | −7.232 | 57.864 |
| 6.6779 | −10.336 | 60.864 | 6.011 | −10.2295 | 59.864 | 5.6315 | −9.1771 | 58.864 | 7.0025 | −9.1928 | 57.864 |
| 5.5372 | −9.2375 | 60.864 | 5.5053 | −8.4331 | 59.864 | 7.2871 | −8.6998 | 58.864 | 6.0386 | −9.8929 | 57.864 |
| 6.9696 | −9.9197 | 60.864 | 7.3116 | −6.2596 | 59.864 | 6.807 | −9.728 | 58.864 | 6.4015 | −9.8755 | 57.864 |
| 5.7165 | −9.9579 | 60.864 | 6.8897 | −9.8326 | 59.864 | 5.5022 | −7.711 | 58.864 | 7.3695 | −6.1508 | 57.864 |
| 7.2833 | −9.0829 | 60.864 | 5.8499 | −10.0588 | 59.864 | 7.4649 | −7.6096 | 58.864 | 6.5226 | −9.799 | 57.864 |
| 5.9664 | −10.3616 | 60.864 | 7.2806 | −8.9092 | 59.864 | 6.4901 | −10.0437 | 58.864 | 6.2769 | −9.9203 | 57.864 |
| 7.4462 | −7.8899 | 60.864 | 6.1334 | −10.2992 | 59.864 | 7.4006 | −6.4961 | 58.864 | 5.661 | −9.228 | 57.864 |

TABLE 1-continued

| | | | | | | | | | | | |
|---|---|---|---|---|---|---|---|---|---|---|---|
| 6.2377 | −10.5211 | 60.864 | 7.2302 | −9.0785 | 59.864 | 6.1771 | −10.1238 | 58.864 | 7.2772 | −8.5319 | 57.864 |
| 7.3454 | −6.6391 | 60.864 | 5.5729 | −9.058 | 59.864 | 5.8804 | −9.9398 | 58.864 | 6.6308 | −9.7051 | 57.864 |
| 6.5191 | −10.464 | 60.864 | 5.6593 | −9.5741 | 59.864 | 5.6907 | −9.5186 | 58.864 | 7.4663 | −7.4599 | 57.864 |
| 5.449 | −8.6061 | 60.864 | 7.3625 | −6.5022 | 59.864 | 7.0227 | −9.3761 | 58.864 | 5.6344 | −8.9969 | 57.864 |
| 6.7678 | −10.2341 | 60.864 | 7.4171 | −8.2294 | 59.864 | 5.6006 | −8.8734 | 58.864 | 5.9719 | −9.8554 | 57.864 |
| 5.6214 | −9.6539 | 60.864 | 5.5486 | −8.8499 | 59.864 | 7.3833 | −8.2982 | 58.864 | 5.8583 | −9.7541 | 57.864 |
| 7.1192 | −9.5944 | 60.864 | 7.3823 | −8.458 | 59.864 | 6.6578 | −9.9045 | 58.864 | 7.2207 | −8.7021 | 57.864 |
| 5.8066 | −10.1501 | 60.864 | 7.443 | −7.983 | 59.864 | 7.4664 | −7.147 | 58.864 | 5.6917 | −9.3893 | 57.864 |
| 7.3785 | −8.6236 | 60.864 | 6.3782 | −10.3126 | 59.864 | 6.36 | −10.1076 | 58.864 | 6.8489 | −9.4424 | 57.864 |
| 6.092 | −10.459 | 60.864 | 5.6014 | −9.2655 | 59.864 | 7.3135 | −6.0687 | 58.864 | 7.4588 | −6.7893 | 57.864 |
| 7.4377 | −7.3873 | 60.864 | 6.1928 | −10.3187 | 59.864 | 6.0606 | −10.0844 | 58.864 | 5.6748 | −9.3089 | 57.864 |
| 6.3427 | −10.5274 | 60.864 | 5.7157 | −9.7757 | 59.864 | 5.7858 | −9.7935 | 58.864 | 6.2164 | −9.9284 | 57.864 |
| 7.2323 | −6.1493 | 60.864 | 7.3368 | −8.6848 | 59.864 | 5.653 | −9.3282 | 58.864 | 5.6233 | −8.8467 | 57.864 |

| Section 5 | | | Section 6 | | | Section 7 | | | Section 8 | | |
|---|---|---|---|---|---|---|---|---|---|---|---|
| X | X | Y | Z | X | X | X | Y | Z | X | Y | Z |
| 2.1341 | −0.9097 | 56.864 | 1.9143 | −1.0939 | 55.864 | 0.5679 | −0.0795 | 54.864 | 0.596 | −0.1669 | 53.864 |
| 0.5049 | −0.0752 | 56.864 | 0.6653 | −0.2718 | 55.864 | 0.5859 | −0.0778 | 54.864 | 2.734 | −1.153 | 53.864 |
| 0.8354 | −0.4071 | 56.864 | 0.8484 | −0.2223 | 55.864 | 0.5366 | −0.1574 | 54.864 | 1.7177 | −0.6183 | 53.864 |
| 0.4336 | −0.1566 | 56.864 | 2.6919 | −1.6799 | 55.864 | 0.6363 | −0.0981 | 54.864 | 0.5889 | −0.1269 | 53.864 |
| 2.176 | −1.3329 | 56.864 | 0.4771 | −0.1474 | 55.864 | 1.6389 | −0.8671 | 54.864 | 0.6909 | −0.1041 | 53.864 |
| 1.0674 | −0.3521 | 56.864 | 1.2695 | −0.6566 | 55.864 | 0.8093 | −0.3338 | 54.864 | 1.9741 | −1.0561 | 53.864 |
| 0.5465 | −0.2262 | 56.864 | 0.5795 | −0.2186 | 55.864 | 0.531 | −0.1166 | 54.864 | 2.2272 | −0.8831 | 53.864 |
| 0.4575 | −0.0623 | 56.864 | 0.5485 | −0.076 | 55.864 | 0.6032 | −0.0824 | 54.864 | 0.9559 | −0.3974 | 53.864 |
| 1.4242 | −0.7934 | 56.864 | 1.6412 | −0.6253 | 55.864 | 2.5023 | −1.4729 | 54.864 | 2.7651 | −1.6177 | 53.864 |
| 0.4155 | −0.0953 | 56.864 | 2.1653 | −0.9027 | 55.864 | 2.7098 | −1.1714 | 54.864 | 1.2975 | −0.6135 | 53.864 |
| 2.6391 | −1.7033 | 56.864 | 0.4819 | −0.0896 | 55.864 | 0.8985 | −0.2265 | 54.864 | 0.6693 | −0.0937 | 53.864 |
| 2.6617 | −1.1994 | 56.864 | 0.4705 | −0.124 | 55.864 | 0.5386 | −0.1001 | 54.864 | 0.6234 | −0.0884 | 53.864 |
| 0.5275 | −0.086 | 56.864 | 2.6858 | −1.1866 | 55.864 | 1.9566 | −1.0821 | 54.864 | 0.6128 | −0.1836 | 53.864 |
| 0.6592 | −0.296 | 56.864 | 0.4956 | −0.0774 | 55.864 | 1.0643 | −0.4944 | 54.864 | 2.3074 | −1.285 | 53.864 |
| 0.4251 | −0.0793 | 56.864 | 2.23 | −1.3222 | 55.864 | 2.1962 | −0.894 | 54.864 | 0.9488 | −0.2304 | 53.864 |
| 1.9383 | −1.1554 | 56.864 | 0.5653 | −0.0841 | 55.864 | 0.6199 | −0.0902 | 54.864 | 0.6468 | −0.086 | 53.864 |
| 0.4176 | −0.1376 | 56.864 | 0.5128 | −0.0708 | 55.864 | 0.5514 | −0.0872 | 54.864 | 0.5879 | −0.1447 | 53.864 |
| 1.6027 | −0.6271 | 56.864 | 0.751 | −0.3253 | 55.864 | 0.5292 | −0.1345 | 54.864 | 1.6371 | −0.8327 | 53.864 |
| 0.4903 | −0.191 | 56.864 | 1.1137 | −0.3546 | 55.864 | 2.7308 | −1.6476 | 54.864 | 0.6076 | −0.097 | 53.864 |
| 0.4821 | −0.0648 | 56.864 | 0.4732 | −0.1058 | 55.864 | 1.3181 | −0.6568 | 54.864 | 0.5957 | −0.1104 | 53.864 |
| 1.1479 | −0.6089 | 56.864 | 1.5938 | −0.8724 | 55.864 | 1.6794 | −0.6225 | 54.864 | 1.2058 | −0.3583 | 53.864 |
| 2.4098 | −1.5154 | 56.864 | 0.5311 | −0.0704 | 55.864 | 1.1596 | −0.3568 | 54.864 | 2.5378 | −1.4493 | 53.864 |
| 0.798 | −0.2179 | 56.864 | 2.463 | −1.4985 | 55.864 | 2.2703 | −1.3028 | 54.864 | 4.7171 | −2.3122 | 53.864 |
| 0.6029 | −0.261 | 56.864 | 0.4935 | −0.1656 | 55.864 | 0.5533 | −0.1747 | 54.864 | 4.8805 | −3.8852 | 53.864 |
| 0.4397 | −0.0678 | 56.864 | 0.8366 | −0.379 | 55.864 | 4.8893 | −2.484 | 54.864 | 4.2364 | −2.9759 | 53.864 |
| 1.6974 | −0.9824 | 56.864 | 0.582 | −0.0921 | 55.864 | 4.0659 | −1.9515 | 54.864 | 3.2086 | −1.9691 | 53.864 |
| 0.4119 | −0.1135 | 56.864 | 4.9555 | −2.5809 | 55.864 | 4.7877 | −3.8981 | 54.864 | 5.4115 | −2.8001 | 53.864 |
| 3.9124 | −2.9938 | 56.864 | 4.6002 | −3.7847 | 55.864 | 4.0095 | −2.8342 | 54.864 | 3.6557 | −1.6651 | 53.864 |
| 4.0923 | −2.0436 | 56.864 | 3.7679 | −2.6896 | 55.864 | 2.9552 | −1.8275 | 54.864 | 4.6411 | −3.5058 | 53.864 |
| 3.3073 | −2.3174 | 56.864 | 5.7788 | −3.2349 | 55.864 | 3.2199 | −1.4553 | 54.864 | 3.8469 | −2.5519 | 53.864 |
| 4.9696 | −2.637 | 56.864 | 3.8436 | −1.8549 | 55.864 | 4.6181 | −2.3014 | 54.864 | 4.9524 | −2.4694 | 53.864 |
| 4.2732 | −3.4788 | 56.864 | 4.3086 | −3.352 | 55.864 | 3.5037 | −1.6176 | 54.864 | 4.3773 | −3.1479 | 53.864 |
| 3.4899 | −1.6751 | 56.864 | 3.3531 | −2.263 | 55.864 | 4.5095 | −3.4663 | 54.864 | 5.7633 | −3.085 | 53.864 |
| 5.6647 | −3.1923 | 56.864 | 4.4729 | −2.2513 | 55.864 | 3.606 | −2.41 | 54.864 | 3.4274 | −2.1568 | 53.864 |
| 3.7186 | −2.7615 | 56.864 | 4.7338 | −4.0088 | 55.864 | 5.7712 | −3.1637 | 54.864 | 5.5895 | −2.94 | 53.864 |
| 4.3889 | −2.2351 | 56.864 | 3.9639 | −2.9132 | 55.864 | 4.3435 | −2.1241 | 54.864 | 5.1842 | −2.6317 | 53.864 |
| 4.5952 | −3.9898 | 56.864 | 3.2025 | −1.4777 | 55.864 | 4.1992 | −3.0572 | 54.864 | 4.7633 | −3.6915 | 53.864 |
| 3.0909 | −2.1058 | 56.864 | 2.9163 | −1.8669 | 55.864 | 3.175 | −2.013 | 54.864 | 4.0458 | −2.7601 | 53.864 |
| 5.2068 | −2.8151 | 56.864 | 5.4222 | −2.9326 | 55.864 | 5.4169 | −2.8701 | 54.864 | 2.9889 | −1.7907 | 53.864 |
| 4.0976 | −3.2331 | 56.864 | 4.4583 | −3.5657 | 55.864 | 3.7858 | −1.7828 | 54.864 | 4.479 | −2.1594 | 53.864 |
| 3.7925 | −1.8571 | 56.864 | 3.5641 | −2.4729 | 55.864 | 4.6529 | −3.6795 | 54.864 | 4.0699 | −1.908 | 53.864 |
| 3.5167 | −2.536 | 56.864 | 5.6028 | −3.0811 | 55.864 | 3.8115 | −2.6186 | 54.864 | 4.5123 | −3.3245 | 53.864 |
| 4.6816 | −2.4326 | 56.864 | 3.5242 | −1.6643 | 55.864 | 5.1559 | −2.6731 | 54.864 | 3.2376 | −1.4289 | 53.864 |
| 4.4392 | −3.7311 | 56.864 | 4.16 | −2.0503 | 55.864 | 4.3581 | −3.2589 | 54.864 | 3.6404 | −2.3509 | 53.864 |
| 3.1851 | −1.4967 | 56.864 | 4.1515 | −3.1438 | 55.864 | 3.3936 | −2.2082 | 54.864 | 5.5901 | −6.0317 | 53.864 |
| 2.8679 | −1.9012 | 56.864 | 4.7158 | −2.4137 | 55.864 | 5.5962 | −3.0143 | 54.864 | 5.3466 | −4.9145 | 53.864 |
| 5.4389 | −2.9999 | 56.864 | 3.1356 | −2.0599 | 55.864 | 5.5625 | −6.1745 | 54.864 | 7.2717 | −5.4515 | 53.864 |
| 4.7407 | −4.2545 | 56.864 | 5.1912 | −2.7536 | 55.864 | 7.0923 | −4.9575 | 54.864 | 6.0953 | −3.3928 | 53.864 |
| 5.2924 | −5.6343 | 56.864 | 7.0183 | −4.8656 | 55.864 | 5.3092 | −5.0399 | 54.864 | 6.7847 | −4.2664 | 53.864 |
| 7.1765 | −5.3388 | 56.864 | 5.5325 | −6.3712 | 55.864 | 6.5491 | −3.9978 | 54.864 | 5.6263 | −6.7507 | 53.864 |
| 5.5615 | −7.1203 | 56.864 | 5.1778 | −4.9521 | 55.864 | 5.6115 | −6.9044 | 54.864 | 5.5198 | −5.5707 | 53.864 |
| 6.7082 | −4.387 | 56.864 | 7.1068 | −5.0684 | 55.864 | 7.2966 | −5.5781 | 54.864 | 5.1854 | −4.4916 | 53.864 |
| 6.0358 | −3.5456 | 56.864 | 7.2547 | −5.4856 | 55.864 | 5.4869 | −5.7066 | 54.864 | 7.1488 | −5.0408 | 53.864 |
| 4.9965 | −4.7956 | 56.864 | 5.6015 | −7.26 | 55.864 | 6.9071 | −4.5632 | 54.864 | 5.9322 | −3.2358 | 53.864 |
| 5.4343 | −6.2223 | 56.864 | 6.6912 | −4.2791 | 55.864 | 5.1361 | −4.5848 | 54.864 | 6.536 | −3.8981 | 53.864 |
| 7.0154 | −4.9471 | 56.864 | 5.4287 | −5.7913 | 55.864 | 6.2629 | −3.6481 | 54.864 | 5.6114 | −6.2708 | 53.864 |
| 6.4601 | −4.0341 | 56.864 | 4.9745 | −4.4716 | 55.864 | 5.5874 | −6.4172 | 54.864 | 5.4136 | −5.1307 | 53.864 |
| 5.2052 | −5.3508 | 56.864 | 5.5663 | −6.6666 | 55.864 | 7.1703 | −5.1609 | 54.864 | 7.3508 | −5.8479 | 53.864 |
| 7.2442 | −5.5396 | 56.864 | 6.4206 | −3.9082 | 55.864 | 5.3774 | −5.2597 | 54.864 | 4.9902 | −4.0832 | 53.864 |
| 5.5295 | −6.8195 | 56.864 | 5.2743 | −5.2279 | 55.864 | 6.6794 | −4.1825 | 54.864 | 7.0725 | −4.8405 | 53.864 |
| 6.8203 | −4.5713 | 56.864 | 7.3602 | −5.9025 | 55.864 | 4.9134 | −4.122 | 54.864 | 5.6218 | −6.9908 | 53.864 |
| 6.1835 | −3.703 | 56.864 | 6.9202 | −4.6672 | 55.864 | 5.6125 | −7.1484 | 54.864 | 5.5588 | −5.7936 | 53.864 |

TABLE 1-continued

| | | | | | | | | | | | |
|---|---|---|---|---|---|---|---|---|---|---|---|
| 4.8752 | −4.5249 | 56.864 | 6.2728 | −3.7325 | 55.864 | 7.3422 | −5.7785 | 54.864 | 5.2704 | −4.7014 | 53.864 |
| 5.3694 | −5.9269 | 56.864 | 6.1147 | −3.5603 | 55.864 | 5.5283 | −5.9329 | 54.864 | 7.2153 | −5.2447 | 53.864 |
| 7.1002 | −5.1412 | 56.864 | 5.4866 | −6.0775 | 55.864 | 7.0045 | −4.7581 | 54.864 | 6.9863 | −4.6443 | 53.864 |
| 6.588 | −4.2079 | 56.864 | 5.081 | −4.7098 | 55.864 | 5.2322 | −4.823 | 54.864 | 6.6652 | −4.0791 | 53.864 |
| 5.8828 | −3.3934 | 56.864 | 5.9498 | −3.3945 | 55.864 | 6.41 | −3.8196 | 54.864 | 5.6232 | −6.5107 | 53.864 |
| 5.1065 | −5.0711 | 56.864 | 7.3137 | −5.699 | 55.864 | 6.1054 | −3.4802 | 54.864 | 5.4714 | −5.3496 | 53.864 |
| 7.3065 | −5.7556 | 56.864 | 6.8126 | −4.4739 | 55.864 | 5.9412 | −3.3189 | 54.864 | 7.3158 | −5.6488 | 53.864 |
| 5.4874 | −6.5201 | 56.864 | 5.5888 | −6.963 | 55.864 | 5.6035 | −6.6606 | 54.864 | 5.0919 | −4.2854 | 53.864 |
| 6.922 | −4.757 | 56.864 | 7.1856 | −5.2752 | 55.864 | 7.2385 | −5.368 | 54.864 | 6.2518 | −3.5564 | 53.864 |
| 6.3251 | −3.8657 | 56.864 | 6.5603 | −4.0905 | 55.864 | 5.4366 | −5.482 | 54.864 | 6.8903 | −4.4528 | 53.864 |
| 5.785 | −9.5041 | 56.864 | 5.358 | −5.5079 | 55.864 | 6.8001 | −4.3735 | 54.864 | 6.398 | −3.7238 | 53.864 |
| 7.4439 | −7.4999 | 56.864 | 4.8587 | −4.2379 | 55.864 | 5.0297 | −4.351 | 54.864 | 5.6111 | −7.2307 | 53.864 |
| 6.0674 | −9.7168 | 56.864 | 6.4223 | −9.4233 | 55.864 | 6.3097 | −9.2671 | 54.864 | 7.3768 | −6.0483 | 53.864 |
| 7.4333 | −6.4172 | 56.864 | 6.0909 | −9.5238 | 55.864 | 5.9993 | −9.3131 | 54.864 | 6.1999 | −9.0967 | 53.864 |
| 6.3734 | −9.6714 | 56.864 | 7.4547 | −6.731 | 55.864 | 5.7547 | −9.1631 | 54.864 | 5.9175 | −9.0971 | 53.864 |
| 6.6667 | −9.4419 | 56.864 | 5.8272 | −9.4013 | 55.864 | 5.6043 | −8.827 | 54.864 | 6.5743 | −8.865 | 53.864 |
| 5.6129 | −8.4823 | 56.864 | 7.3451 | −7.8294 | 55.864 | 7.3181 | −7.675 | 54.864 | 5.6935 | −8.9247 | 53.864 |
| 7.0533 | −8.8729 | 56.864 | 5.6553 | −9.0927 | 55.864 | 6.9133 | −8.6648 | 54.864 | 6.969 | −8.341 | 53.864 |
| 5.6836 | −9.2634 | 56.864 | 7.0309 | −8.6885 | 55.864 | 5.5704 | −8.3059 | 54.864 | 5.5654 | −8.5647 | 53.864 |
| 7.342 | −8.0828 | 56.864 | 5.5973 | −8.6321 | 55.864 | 7.4328 | −6.5943 | 54.864 | 7.2788 | −7.5441 | 53.864 |
| 5.8835 | −9.6171 | 56.864 | 7.3976 | −6.1079 | 55.864 | 6.5246 | −9.1278 | 54.864 | 5.5587 | −7.9869 | 53.864 |
| 7.4689 | −7.0771 | 56.864 | 6.641 | −9.2426 | 55.864 | 6.1732 | −9.3122 | 54.864 | 7.401 | −6.6354 | 53.864 |
| 6.1871 | −9.7265 | 56.864 | 6.2664 | −9.499 | 55.864 | 5.8901 | −9.2727 | 54.864 | 6.0299 | −9.1185 | 53.864 |
| 7.3588 | −5.9742 | 56.864 | 5.9757 | −9.4977 | 55.864 | 5.6788 | −9.0497 | 54.864 | 6.3542 | −9.0299 | 53.864 |
| 6.5003 | −9.5922 | 56.864 | 7.4443 | −7.1734 | 55.864 | 7.1461 | −8.2077 | 54.864 | 5.8156 | −9.0451 | 53.864 |
| 5.5987 | −7.7242 | 56.864 | 5.7509 | −9.3108 | 55.864 | 5.5816 | −8.6718 | 54.864 | 6.7208 | −8.7087 | 53.864 |
| 6.8167 | −9.2607 | 56.864 | 7.236 | −8.2091 | 55.864 | 7.3975 | −7.2466 | 54.864 | 5.621 | −8.789 | 53.864 |
| 5.6276 | −8.8835 | 56.864 | 5.6227 | −8.9366 | 55.864 | 6.7515 | −8.8936 | 54.864 | 7.1152 | −8.0378 | 53.864 |
| 7.1902 | −8.5649 | 56.864 | 6.8509 | −8.9858 | 55.864 | 5.5917 | −7.7772 | 54.864 | 5.5516 | −8.4111 | 53.864 |
| 5.7424 | −9.428 | 56.864 | 5.5953 | −8.3396 | 55.864 | 7.406 | −6.1844 | 54.864 | 7.352 | −7.184 | 53.864 |
| 7.4166 | −7.71 | 56.864 | 6.4937 | −9.3737 | 55.864 | 6.3853 | −9.2271 | 54.864 | 5.5946 | −7.4829 | 53.864 |
| 6.0104 | −9.6975 | 56.864 | 6.1503 | −9.5233 | 55.864 | 6.0571 | −9.3207 | 54.864 | 7.3938 | −6.2497 | 53.864 |
| 7.4554 | −6.6408 | 56.864 | 7.4449 | −6.5225 | 55.864 | 5.7954 | −9.2049 | 54.864 | 6.1441 | −9.1102 | 53.864 |
| 6.3046 | −9.7007 | 56.864 | 5.8725 | −9.4394 | 55.864 | 5.6227 | −8.9033 | 54.864 | 6.4932 | −8.935 | 53.864 |
| 6.6141 | −9.495 | 56.864 | 7.3897 | −7.6126 | 55.864 | 7.2608 | −7.8852 | 54.864 | 5.7295 | −8.9694 | 53.864 |
| 5.6093 | −8.2295 | 56.864 | 5.6797 | −9.1686 | 55.864 | 6.9995 | −8.517 | 54.864 | 6.8828 | −8.4857 | 53.864 |
| 6.9729 | −9.0209 | 56.864 | 7.1074 | −8.5323 | 55.864 | 5.57 | −8.4498 | 54.864 | 5.5783 | −8.6408 | 53.864 |
| 5.6641 | −9.1781 | 56.864 | 5.6052 | −8.7781 | 55.864 | 7.4319 | −6.8122 | 54.864 | 7.2293 | −7.721 | 53.864 |
| 7.2982 | −8.2455 | 56.864 | 6.7158 | −9.1611 | 55.864 | 6.6054 | −9.055 | 54.864 | 5.5517 | −8.1282 | 53.864 |
| 5.8304 | −9.564 | 56.864 | 5.6057 | −7.5572 | 55.864 | 6.2299 | −9.2978 | 54.864 | 7.3925 | −6.8189 | 53.864 |
| 7.4612 | −7.2888 | 56.864 | 6.3466 | −9.466 | 55.864 | 5.9432 | −9.2969 | 54.864 | 5.973 | −9.1117 | 53.864 |
| 6.1267 | −9.7266 | 56.864 | 6.0323 | −9.5153 | 55.864 | 5.7189 | −9.117 | 54.864 | 6.279 | −9.0677 | 53.864 |
| 7.4011 | −6.1949 | 56.864 | 7.4549 | −6.9523 | 55.864 | 5.591 | −8.7497 | 54.864 | 5.8648 | −9.0745 | 53.864 |
| 6.4386 | −9.6347 | 56.864 | 5.7866 | −9.3582 | 55.864 | 7.3636 | −7.4618 | 54.864 | 6.65 | −8.7892 | 53.864 |
| 5.5842 | −7.422 | 56.864 | 7.2887 | −8.0434 | 55.864 | 6.8176 | −8.8068 | 54.864 | 5.653 | −8.8592 | 53.864 |
| 6.7445 | −9.3536 | 56.864 | 5.6366 | −9.0151 | 55.864 | 5.5744 | −8.1621 | 54.864 | 7.0463 | −8.1914 | 53.864 |
| 5.6195 | −8.7353 | 56.864 | 6.9455 | −8.8399 | 55.864 | 7.4241 | −6.3891 | 54.864 | 5.5568 | −8.488 | 53.864 |
| 7.1256 | −8.7207 | 56.864 | 5.5947 | −8.4859 | 55.864 | 6.4569 | −9.1802 | 54.864 | 7.3196 | −7.3649 | 53.864 |
| 5.7091 | −9.3471 | 56.864 | 6.5609 | −9.3187 | 55.864 | 6.1154 | −9.3201 | 54.864 | 5.5759 | −7.7348 | 53.864 |
| 7.3792 | −7.9184 | 56.864 | 6.2091 | −9.5147 | 55.864 | 5.8407 | −9.2417 | 54.864 | 7.4017 | −6.4516 | 53.864 |
| 5.9438 | −9.6622 | 56.864 | 7.4259 | −6.3147 | 55.864 | 5.6472 | −8.9779 | 54.864 | 6.0872 | −9.1177 | 53.864 |
| 7.4672 | −6.8652 | 56.864 | 5.9222 | −9.4719 | 55.864 | 7.2073 | −8.0478 | 54.864 | 6.4256 | −8.9852 | 53.864 |
| 6.2468 | −9.7175 | 56.864 | 7.4226 | −7.3937 | 55.864 | 7.077 | −8.3644 | 54.864 | 5.7703 | −9.0098 | 53.864 |
| 6.5587 | −9.5454 | 56.864 | 5.7112 | −9.2419 | 55.864 | 5.5753 | −8.5935 | 54.864 | 6.787 | −8.6243 | 53.864 |
| 5.6053 | −7.9768 | 56.864 | 7.1756 | −8.3723 | 55.864 | 7.4202 | −7.0298 | 54.864 | 5.5964 | −8.7158 | 53.864 |
| 6.8841 | −9.1641 | 56.864 | 5.6124 | −8.8575 | 55.864 | 6.6809 | −8.9766 | 54.864 | 7.1761 | −7.8808 | 53.864 |
| 5.6415 | −9.0313 | 56.864 | 6.7855 | −9.0752 | 55.864 | 5.6077 | −7.3924 | 54.864 | 5.5486 | −8.2697 | 53.864 |
| 7.2477 | −8.4063 | 56.864 | 5.6016 | −7.9483 | 55.864 | 7.3787 | −5.9807 | 54.864 | 7.3762 | −7.0019 | 53.864 |

| Section 9 | | | Section 10 | | | Section 11 | | | Section 12 | | |
|---|---|---|---|---|---|---|---|---|---|---|---|
| X | Y | Z | X | Y | Z | X | Y | Z | X | Y | Z |
| 0.6467 | −0.1544 | 52.864 | 1.3916 | −0.615 | 51.864 | 1.1303 | −0.2547 | 50.864 | 0.9121 | −0.1279 | 49.864 |
| 0.7022 | −0.0936 | 52.864 | 2.6185 | −1.023 | 51.864 | 2.4035 | −1.2353 | 50.864 | 0.8321 | −0.2013 | 49.864 |
| 1.7562 | −0.6127 | 52.864 | 0.7213 | −0.1163 | 51.864 | 0.7921 | −0.1155 | 50.864 | 2.4343 | −1.2155 | 49.864 |
| 1.3449 | −0.6145 | 52.864 | 0.7056 | −0.1636 | 51.864 | 1.5999 | −0.7166 | 50.864 | 2.6696 | −0.9793 | 49.864 |
| 0.6532 | −0.1204 | 52.864 | 1.7203 | −0.8249 | 51.864 | 0.7645 | −0.1725 | 50.864 | 1.3921 | −0.3587 | 49.864 |
| 2.0117 | −1.0466 | 52.864 | 0.7141 | −0.1849 | 51.864 | 1.1953 | −0.4617 | 50.864 | 0.8234 | −0.181 | 49.864 |
| 0.7458 | −0.1101 | 52.864 | 1.0501 | −0.2374 | 51.864 | 0.7749 | −0.1298 | 50.864 | 1.3789 | −0.5461 | 49.864 |
| 2.7584 | −1.1315 | 52.864 | 0.7056 | −0.1464 | 51.864 | 1.3453 | −0.3593 | 50.864 | 1.1522 | −0.2432 | 49.864 |
| 1.6793 | −0.8289 | 52.864 | 1.9599 | −0.6886 | 51.864 | 2.0028 | −0.9742 | 50.864 | 0.848 | −0.2165 | 49.864 |
| 0.6551 | −0.1761 | 52.864 | 2.0475 | −1.0373 | 51.864 | 1.9958 | −0.6785 | 50.864 | 2.0315 | −0.6677 | 49.864 |
| 0.6793 | −0.0974 | 52.864 | 0.801 | −0.1161 | 51.864 | 0.8137 | −0.1092 | 50.864 | 0.8699 | −0.117 | 49.864 |
| 1.2521 | −0.3592 | 52.864 | 1.0616 | −0.4071 | 51.864 | 0.7652 | −0.1501 | 50.864 | 0.8238 | −0.159 | 49.864 |
| 0.6719 | −0.1923 | 52.864 | 0.7307 | −0.2007 | 51.864 | 0.7731 | −0.1932 | 50.864 | 0.849 | −0.1242 | 49.864 |
| 1.009 | −0.4025 | 52.864 | 0.7802 | −0.1061 | 51.864 | 2.6444 | −1.0014 | 50.864 | 0.8327 | −0.1389 | 49.864 |
| 0.6472 | −0.1369 | 52.864 | 0.711 | −0.1301 | 51.864 | 0.7894 | −0.2088 | 50.864 | 0.8919 | −0.1189 | 49.864 |
| 2.3411 | −1.2687 | 52.864 | 1.2987 | −0.3595 | 51.864 | 0.8564 | −0.122 | 50.864 | 1.908 | −0.8787 | 49.864 |
| 0.7246 | −0.0999 | 52.864 | 0.7578 | −0.1014 | 51.864 | 0.9934 | −0.1883 | 50.864 | 3.6538 | −2.0797 | 49.864 |

TABLE 1-continued

| | | | | | | | | | | | |
|---|---|---|---|---|---|---|---|---|---|---|---|
| 2.2584 | −0.87 | 52.864 | 0.7356 | −0.1065 | 51.864 | 0.8359 | −0.1124 | 50.864 | 5.8 | −2.7861 | 49.864 |
| 0.6643 | −0.1067 | 52.864 | 2.3724 | −1.253 | 51.864 | 3.6924 | −1.5417 | 50.864 | 5.5221 | −2.5734 | 49.864 |
| 0.9993 | −0.234 | 52.864 | 4.7192 | −2.1852 | 51.864 | 4.8103 | −3.4217 | 50.864 | 4.8136 | −3.3347 | 49.864 |
| 3.2555 | −1.3984 | 52.864 | 4.8022 | −3.5093 | 51.864 | 5.8979 | −2.9515 | 50.864 | 4.151 | −2.5256 | 49.864 |
| 4.9513 | −2.403 | 52.864 | 5.7458 | −2.9071 | 51.864 | 4.1394 | −2.5919 | 50.864 | 3.301 | −1.8079 | 49.864 |
| 4.6669 | −3.4162 | 52.864 | 4.1243 | −2.6583 | 51.864 | 5.1704 | −2.4048 | 50.864 | 5.934 | −2.8986 | 49.864 |
| 3.874 | −2.4894 | 52.864 | 3.2596 | −1.8894 | 51.864 | 3.281 | −1.8493 | 50.864 | 4.7133 | −2.0526 | 49.864 |
| 2.6449 | −1.4813 | 52.864 | 3.6813 | −1.5844 | 51.864 | 5.3912 | −2.5563 | 50.864 | 4.4857 | −1.9217 | 49.864 |
| 4.078 | −1.8611 | 52.864 | 5.1771 | −2.4826 | 51.864 | 4.5657 | −3.0794 | 50.864 | 4.5723 | −3.0003 | 49.864 |
| 5.4063 | −2.7228 | 52.864 | 4.5546 | −3.159 | 51.864 | 3.8097 | −2.2793 | 50.864 | 4.0957 | −1.7067 | 49.864 |
| 4.404 | −3.0673 | 52.864 | 3.7922 | −2.3355 | 51.864 | 4.4871 | −1.9824 | 50.864 | 3.8245 | −2.2227 | 49.864 |
| 3.4548 | −2.1087 | 52.864 | 2.6727 | −1.4587 | 51.864 | 2.7 | −1.4343 | 50.864 | 2.7267 | −1.4078 | 49.864 |
| 4.7183 | −2.2513 | 52.864 | 4.4861 | −2.0432 | 51.864 | 3.2899 | −1.3306 | 50.864 | 4.9259 | −3.512 | 49.864 |
| 4.7886 | −3.5977 | 52.864 | 4.9176 | −3.6947 | 51.864 | 4.9243 | −3.6031 | 50.864 | 4.3052 | −2.6862 | 49.864 |
| 5.755 | −2.9989 | 52.864 | 5.575 | −2.7709 | 51.864 | 5.7334 | −2.8142 | 50.864 | 5.1607 | −2.327 | 49.864 |
| 4.0729 | −2.6907 | 52.864 | 4.2815 | −2.8283 | 51.864 | 4.2953 | −2.7571 | 50.864 | 3.479 | −1.9417 | 49.864 |
| 2.9438 | −1.7006 | 52.864 | 3.4409 | −2.0336 | 51.864 | 3.4609 | −1.9881 | 50.864 | 4.9385 | −2.1873 | 49.864 |
| 3.6685 | −1.6266 | 52.864 | 3.2733 | −1.3648 | 51.864 | 4.0918 | −1.7583 | 50.864 | 5.3791 | −2.4725 | 49.864 |
| 5.1809 | −2.5599 | 52.864 | 4.9498 | −2.3313 | 51.864 | 4.6914 | −3.2482 | 50.864 | 3.3052 | −1.296 | 49.864 |
| 4.5386 | −3.2393 | 52.864 | 4.6817 | −3.3318 | 51.864 | 3.9773 | −2.4327 | 50.864 | 4.6963 | −3.1651 | 49.864 |
| 3.6676 | −2.2955 | 52.864 | 5.9118 | −3.0491 | 51.864 | 2.993 | −1.6383 | 50.864 | 5.6625 | −2.6778 | 49.864 |
| 4.4826 | −2.1037 | 52.864 | 3.961 | −2.4941 | 51.864 | 5.0309 | −3.7889 | 50.864 | 3.9905 | −2.3712 | 49.864 |
| 4.9052 | −3.7871 | 52.864 | 2.9689 | −1.6702 | 51.864 | 4.9456 | −2.2593 | 50.864 | 3.0161 | −1.6046 | 49.864 |
| 5.5827 | −2.8583 | 52.864 | 4.0859 | −1.8099 | 51.864 | 5.5643 | −2.6827 | 50.864 | 3.7018 | −1.4988 | 49.864 |
| 4.2633 | −2.9001 | 52.864 | 5.4003 | −2.6399 | 51.864 | 4.4336 | −2.9156 | 50.864 | 5.0309 | −3.6939 | 49.864 |
| 3.2365 | −1.9283 | 52.864 | 4.4211 | −2.9911 | 51.864 | 4.7176 | −2.1188 | 50.864 | 4.4419 | −2.8406 | 49.864 |
| 5.2083 | −4.3812 | 52.864 | 3.6186 | −2.1821 | 51.864 | 3.6374 | −2.1313 | 50.864 | 6.607 | −3.6475 | 49.864 |
| 5.9226 | −3.1454 | 52.864 | 7.1494 | −4.9818 | 51.864 | 6.8067 | −4.0628 | 50.864 | 6.1892 | −3.1379 | 49.864 |
| 6.6486 | −3.9688 | 52.864 | 5.588 | −5.5298 | 51.864 | 7.1185 | −4.8723 | 50.864 | 6.8539 | −4.0881 | 49.864 |
| 7.1213 | −4.915 | 52.864 | 5.3015 | −4.4783 | 51.864 | 5.5895 | −5.4006 | 50.864 | 5.6435 | −6.2228 | 49.864 |
| 5.6284 | −6.1289 | 52.864 | 6.4511 | −3.6115 | 51.864 | 5.3037 | −4.3704 | 50.864 | 7.1154 | −4.8973 | 49.864 |
| 5.4349 | −5.0084 | 52.864 | 6.9373 | −4.3993 | 51.864 | 6.535 | −3.6314 | 50.864 | 5.5833 | −5.2718 | 49.864 |
| 5.0143 | −3.981 | 52.864 | 5.6479 | −6.2217 | 51.864 | 6.9541 | −4.3776 | 50.864 | 5.2997 | −4.2631 | 49.864 |
| 6.2396 | −3.4574 | 52.864 | 5.501 | −5.1019 | 51.864 | 5.6503 | −6.0791 | 50.864 | 6.3023 | −3.258 | 49.864 |
| 6.87 | −4.3359 | 52.864 | 5.1257 | −4.0786 | 51.864 | 5.5021 | −4.9813 | 50.864 | 6.981 | −4.4043 | 49.864 |
| 5.5785 | −5.6597 | 52.864 | 6.0721 | −3.1974 | 51.864 | 5.1298 | −3.979 | 50.864 | 5.6423 | −5.8411 | 49.864 |
| 5.2927 | −4.587 | 52.864 | 6.6536 | −3.8884 | 51.864 | 6.209 | −3.246 | 50.864 | 5.496 | −4.8613 | 49.864 |
| 6.5211 | −3.7915 | 52.864 | 7.0887 | −4.784 | 51.864 | 6.7215 | −3.9113 | 50.864 | 6.5118 | −3.5128 | 49.864 |
| 7.0475 | −4.7177 | 52.864 | 5.6185 | −5.7594 | 51.864 | 7.0711 | −4.705 | 50.864 | 5.1283 | −3.8798 | 49.864 |
| 5.6382 | −6.3647 | 52.864 | 5.3768 | −4.6833 | 51.864 | 5.6204 | −5.6257 | 50.864 | 6.41 | −3.383 | 49.864 |
| 5.4923 | −5.2233 | 52.864 | 6.3411 | −3.4797 | 51.864 | 5.3783 | −4.5712 | 50.864 | 7.0777 | −4.731 | 49.864 |
| 5.1154 | −4.1791 | 52.864 | 6.8463 | −4.2137 | 51.864 | 6.432 | −3.4982 | 50.864 | 5.6107 | −5.4607 | 49.864 |
| 6.0844 | −3.298 | 52.864 | 5.5492 | −5.3149 | 51.864 | 6.8842 | −4.2184 | 50.864 | 5.3734 | −4.4597 | 49.864 |
| 6.7664 | −4.1527 | 52.864 | 5.2178 | −4.2766 | 51.864 | 5.6497 | −6.3063 | 50.864 | 6.9213 | −4.2446 | 49.864 |
| 7.1852 | −5.1157 | 52.864 | 6.5555 | −3.7477 | 51.864 | 7.1589 | −5.0415 | 50.864 | 5.6466 | −6.0319 | 49.864 |
| 5.6086 | −5.8937 | 52.864 | 7.0181 | −4.5897 | 51.864 | 5.5505 | −5.19 | 50.864 | 6.064 | −3.0157 | 49.864 |
| 5.3684 | −4.7962 | 52.864 | 5.6384 | −5.9902 | 51.864 | 5.2208 | −4.1729 | 50.864 | 7.1492 | −5.0817 | 49.864 |
| 6.3845 | −3.6209 | 52.864 | 5.4434 | −4.8913 | 51.864 | 6.0568 | −3.0953 | 50.864 | 5.5443 | −5.0656 | 49.864 |
| 6.9637 | −4.5245 | 52.864 | 5.0255 | −3.8845 | 51.864 | 6.6316 | −3.7691 | 50.864 | 5.2179 | −4.0697 | 49.864 |
| 5.5402 | −5.4406 | 52.864 | 6.2258 | −3.3526 | 51.864 | 7.0164 | −4.54 | 50.864 | 7.033 | −4.5666 | 49.864 |
| 7.3604 | −6.4835 | 52.864 | 6.7452 | −4.0334 | 51.864 | 5.6406 | −5.852 | 50.864 | 5.6303 | −5.6506 | 49.864 |
| 5.7972 | −8.8495 | 52.864 | 6.1588 | −8.6945 | 51.864 | 5.4446 | −4.775 | 50.864 | 5.4389 | −4.6592 | 49.864 |
| 7.2421 | −7.3769 | 52.864 | 7.3073 | −5.954 | 51.864 | 6.3232 | −3.3697 | 50.864 | 6.6953 | −3.7867 | 49.864 |
| 5.601 | −8.6018 | 52.864 | 5.8337 | −8.6805 | 51.864 | 6.5035 | −8.2801 | 50.864 | 6.7786 | −3.9353 | 49.864 |
| 6.9838 | −8.0772 | 52.864 | 7.2677 | −6.8557 | 51.864 | 5.6394 | −6.5333 | 50.864 | 6.7576 | −7.7466 | 49.864 |
| 5.5338 | −8.2306 | 52.864 | 5.6201 | −8.4827 | 51.864 | 6.1451 | −8.4931 | 50.864 | 5.5311 | −7.3012 | 49.864 |
| 6.6228 | −8.599 | 52.864 | 7.0662 | −7.639 | 51.864 | 7.2577 | −5.7994 | 50.864 | 6.4088 | −8.1442 | 49.864 |
| 5.5945 | −7.3196 | 52.864 | 5.5248 | −8.126 | 51.864 | 5.8257 | −8.4832 | 50.864 | 6.0705 | −8.307 | 49.864 |
| 6.2544 | −8.8679 | 52.864 | 6.7333 | −8.2485 | 51.864 | 7.2197 | −6.6842 | 50.864 | 7.2106 | −5.8283 | 49.864 |
| 7.3385 | −5.9066 | 52.864 | 5.568 | −7.4007 | 51.864 | 5.6114 | −8.2945 | 50.864 | 5.7509 | −8.2492 | 49.864 |
| 5.9533 | −8.9114 | 52.864 | 6.3785 | −8.5906 | 51.864 | 7.0292 | −7.4544 | 50.864 | 7.1431 | −6.6768 | 49.864 |
| 7.3362 | −6.8437 | 52.864 | 7.2394 | −5.3733 | 51.864 | 5.5152 | −7.9457 | 50.864 | 5.5556 | −8.0016 | 49.864 |
| 5.7109 | −8.7771 | 52.864 | 6.0223 | −8.7166 | 51.864 | 6.7077 | −8.0548 | 50.864 | 6.9411 | −7.3898 | 49.864 |
| 7.1503 | −7.6858 | 52.864 | 7.3126 | −6.3261 | 51.864 | 5.5648 | −7.2347 | 50.864 | 5.5061 | −7.6939 | 49.864 |
| 5.5584 | −8.4565 | 52.864 | 5.7396 | −8.6227 | 51.864 | 6.3605 | −8.391 | 50.864 | 6.6211 | −7.9357 | 49.864 |
| 6.8411 | −8.3223 | 52.864 | 7.2011 | −7.204 | 51.864 | 7.1953 | −5.2293 | 50.864 | 5.5913 | −6.8364 | 49.864 |
| 5.5385 | −7.9528 | 52.864 | 5.5619 | −8.3459 | 51.864 | 6.0114 | −8.5156 | 50.864 | 6.2788 | −8.2305 | 49.864 |
| 6.4669 | −8.7403 | 52.864 | 6.9531 | −7.8935 | 51.864 | 7.262 | −6.1645 | 50.864 | 7.1753 | −5.2673 | 49.864 |
| 5.6307 | −6.8366 | 52.864 | 5.5223 | −7.9152 | 51.864 | 5.732 | −8.4289 | 50.864 | 5.938 | −8.3132 | 49.864 |
| 7.2391 | −5.3194 | 52.864 | 6.5989 | −8.4059 | 51.864 | 7.1571 | −7.0264 | 50.864 | 7.2017 | −6.169 | 49.864 |
| 6.1215 | −8.9086 | 52.864 | 5.6204 | −6.916 | 51.864 | 5.5522 | −8.1613 | 50.864 | 5.6502 | −8.1628 | 49.864 |
| 7.3614 | −6.303 | 52.864 | 6.2354 | −8.6675 | 51.864 | 6.9208 | −7.7051 | 50.864 | 7.0699 | −7.0097 | 49.864 |
| 5.8462 | −8.8772 | 52.864 | 7.2928 | −5.7595 | 51.864 | 5.5142 | −7.7389 | 50.864 | 5.5231 | −7.8809 | 49.864 |
| 7.2815 | −7.2007 | 52.864 | 5.8856 | −8.6996 | 51.864 | 6.5764 | −8.2096 | 50.864 | 6.8256 | −7.6312 | 49.864 |
| 5.6336 | −8.6704 | 52.864 | 7.2898 | −6.6798 | 51.864 | 5.621 | −6.7598 | 50.864 | 5.5178 | −7.4318 | 49.864 |
| 7.0454 | −7.9493 | 52.864 | 5.6617 | −8.5442 | 51.864 | 6.2202 | −8.4665 | 50.864 | 6.4847 | −8.08 | 49.864 |
| 5.5381 | −8.3063 | 52.864 | 7.1137 | −7.5081 | 51.864 | 7.2446 | −5.6086 | 50.864 | 5.6334 | −6.4134 | 49.864 |
| 6.6933 | −8.5206 | 52.864 | 5.5321 | −8.2001 | 51.864 | 5.877 | −8.5009 | 50.864 | 6.1353 | −8.2915 | 49.864 |
| 5.5705 | −7.5668 | 52.864 | 6.8139 | −8.1348 | 51.864 | 7.2404 | −6.5115 | 50.864 | 7.2058 | −5.6409 | 49.864 |
| 6.3288 | −8.8316 | 52.864 | 5.5415 | −7.6429 | 51.864 | 5.6536 | −8.3539 | 50.864 | 5.8096 | −8.2804 | 49.864 |

TABLE 1-continued

| | | | | | | | | | | | |
|---|---|---|---|---|---|---|---|---|---|---|---|
| 7.3141 | −5.7095 | 52.864 | 6.4448 | −8.5437 | 51.864 | 7.0744 | −7.3255 | 50.864 | 7.1689 | −6.5083 | 49.864 |
| 6.0093 | −8.9172 | 52.864 | 5.6474 | −6.4534 | 51.864 | 5.5222 | −8.0184 | 50.864 | 5.5807 | −8.059 | 49.864 |
| 7.352 | −6.6639 | 52.864 | 7.2002 | −5.1823 | 51.864 | 6.7861 | −7.9428 | 50.864 | 6.9896 | −7.265 | 49.864 |
| 5.7519 | −8.8159 | 52.864 | 6.0911 | −8.7098 | 51.864 | 5.5359 | −7.4721 | 50.864 | 5.5085 | −7.7565 | 49.864 |
| 7.1941 | −7.551 | 52.864 | 7.3137 | −6.1489 | 51.864 | 6.4255 | −8.345 | 50.864 | 6.6822 | −7.8572 | 49.864 |
| 5.5763 | −8.5302 | 52.864 | 5.7849 | −8.6546 | 51.864 | 6.0789 | −8.5085 | 50.864 | 5.5607 | −7.0688 | 49.864 |
| 6.9159 | −8.2017 | 52.864 | 7.2383 | −7.0306 | 51.864 | 7.2633 | −5.9906 | 50.864 | 6.3455 | −8.1899 | 49.864 |
| 5.5329 | −8.0916 | 52.864 | 5.587 | −8.416 | 51.864 | 5.7771 | −8.459 | 50.864 | 6.0045 | −8.3147 | 49.864 |
| 6.5475 | −8.6726 | 52.864 | 7.0128 | −7.7676 | 51.864 | 7.1921 | −6.856 | 50.864 | 7.209 | −5.9988 | 49.864 |
| 5.6157 | −7.0722 | 52.864 | 5.5213 | −8.0516 | 51.864 | 5.5776 | −8.2297 | 50.864 | 5.6974 | −8.2096 | 49.864 |
| 6.1765 | −8.8956 | 52.864 | 6.6684 | −8.3292 | 51.864 | 6.9781 | −7.5811 | 50.864 | 7.1102 | −6.8441 | 49.864 |
| 7.3543 | −6.1045 | 52.864 | 5.596 | −7.1585 | 51.864 | 5.5121 | −7.8728 | 50.864 | 5.5367 | −7.942 | 49.864 |
| 5.8985 | −8.898 | 52.864 | 6.3087 | −8.6323 | 51.864 | 6.6444 | −8.1342 | 50.864 | 6.8866 | −7.512 | 49.864 |
| 7.3128 | −7.0228 | 52.864 | 7.2702 | −5.5659 | 51.864 | 5.595 | −6.9975 | 50.864 | 5.5086 | −7.5627 | 49.864 |
| 5.6746 | −8.734 | 52.864 | 5.9533 | −8.7135 | 51.864 | 6.292 | −8.4319 | 50.864 | 6.5553 | −8.0102 | 49.864 |
| 7.1007 | −7.8187 | 52.864 | 7.3046 | −6.5032 | 51.864 | 7.2238 | −5.4185 | 50.864 | 5.6173 | −6.6036 | 49.864 |
| 5.546 | −8.3817 | 52.864 | 5.6984 | −8.5857 | 51.864 | 5.9436 | −8.5134 | 50.864 | 6.2087 | −8.2648 | 49.864 |
| 6.7592 | −8.4382 | 52.864 | 7.1556 | −7.3753 | 51.864 | 7.2544 | −6.3382 | 50.864 | 7.1941 | −5.4538 | 49.864 |
| 5.5481 | −7.814 | 52.864 | 5.5441 | −8.2736 | 51.864 | 5.6906 | −8.3936 | 50.864 | 5.8725 | −8.3018 | 49.864 |
| 6.3996 | −8.7887 | 52.864 | 6.887 | −8.0161 | 51.864 | 7.1141 | −7.1949 | 50.864 | 7.1884 | −6.3389 | 49.864 |
| 5.6386 | −6.6007 | 52.864 | 5.5298 | −7.7789 | 51.864 | 5.5342 | −8.0906 | 50.864 | 5.6122 | −8.1131 | 49.864 |
| 7.281 | −5.5136 | 52.864 | 6.5244 | −8.4777 | 51.864 | 6.8569 | −7.826 | 50.864 | 7.0324 | −7.1382 | 49.864 |
| 6.0656 | −8.9161 | 52.864 | 5.6378 | −6.6849 | 51.864 | 5.523 | −7.6053 | 50.864 | 5.514 | −7.8189 | 49.864 |

| Section 13 | | | Section 14 | | | Section 15 | | | Section 16 | | |
|---|---|---|---|---|---|---|---|---|---|---|---|
| X | Y | Z | X | Y | Z | X | Y | Z | X | Y | Z |
| 1.8435 | −0.8028 | 48.864 | 2.1023 | −0.6442 | 47.864 | 2.5262 | −1.144 | 46.864 | 2.4083 | −1.0297 | 45.864 |
| 1.5317 | −0.609 | 48.864 | 1.0043 | −0.1322 | 47.864 | 1.0215 | −0.1492 | 46.864 | 1.222 | −0.1896 | 45.864 |
| 1.2193 | −0.4161 | 48.864 | 0.9415 | −0.1969 | 47.864 | 1.3546 | −0.4362 | 46.864 | 1.5731 | −0.5343 | 45.864 |
| 2.4651 | −1.1937 | 48.864 | 1.1 | −0.313 | 47.864 | 1.2494 | −0.2233 | 46.864 | 1.0789 | −0.1576 | 45.864 |
| 0.8825 | −0.1892 | 48.864 | 0.9638 | −0.141 | 47.864 | 1.0233 | −0.238 | 46.864 | 1.3767 | −0.4185 | 45.864 |
| 0.9065 | −0.224 | 48.864 | 0.9649 | −0.2311 | 47.864 | 1.0006 | −0.2043 | 46.864 | 1.0822 | −0.2449 | 45.864 |
| 0.9264 | −0.1248 | 48.864 | 1.505 | −0.5595 | 47.864 | 1.6856 | −0.6349 | 46.864 | 2.4667 | −0.7524 | 45.864 |
| 0.891 | −0.209 | 48.864 | 1.0242 | −0.1395 | 47.864 | 1.0607 | −0.1391 | 46.864 | 1.6711 | −0.5923 | 45.864 |
| 0.948 | −0.1255 | 48.864 | 2.4957 | −1.1698 | 47.864 | 1.5332 | −0.354 | 46.864 | 1.1362 | −0.1507 | 45.864 |
| 2.067 | −0.6563 | 48.864 | 0.9413 | −0.1758 | 47.864 | 1.0075 | −0.1644 | 46.864 | 2.6821 | −1.1949 | 45.864 |
| 0.968 | −0.1337 | 48.864 | 1.3701 | −0.4772 | 47.864 | 1.465 | −0.5023 | 46.864 | 1.2784 | −0.3608 | 45.864 |
| 2.6941 | −0.9566 | 48.864 | 2.7179 | −0.9334 | 47.864 | 1.165 | −0.1842 | 46.864 | 1.3311 | −0.2394 | 45.864 |
| 0.8825 | −0.1676 | 48.864 | 0.9832 | −0.1325 | 47.864 | 1.1338 | −0.3039 | 46.864 | 1.1805 | −0.3026 | 45.864 |
| 2.1548 | −0.9975 | 48.864 | 1.4861 | −0.356 | 47.864 | 2.7411 | −0.9096 | 46.864 | 1.0966 | −0.1481 | 45.864 |
| 0.8908 | −0.1477 | 48.864 | 2.0683 | −0.9049 | 47.864 | 1.0087 | −0.2233 | 46.864 | 2.1335 | −0.8661 | 45.864 |
| 0.9062 | −0.1327 | 48.864 | 0.9499 | −0.2163 | 47.864 | 2.1064 | −0.8886 | 46.864 | 1.0592 | −0.192 | 45.864 |
| 1.439 | −0.3576 | 48.864 | 1.235 | −0.3951 | 47.864 | 1.0401 | −0.1402 | 46.864 | 1.0599 | −0.2122 | 45.864 |
| 4.6966 | −3.0824 | 48.864 | 1.2551 | −0.2479 | 47.864 | 1.2441 | −0.3702 | 46.864 | 1.1792 | −0.1701 | 45.864 |
| 4.9225 | −3.4215 | 48.864 | 0.949 | −0.1561 | 47.864 | 1.3339 | −0.2624 | 46.864 | 1.0657 | −0.173 | 45.864 |
| 5.3639 | −2.3884 | 48.864 | 1.6398 | −0.6419 | 47.864 | 1.0002 | −0.1837 | 46.864 | 1.4749 | −0.4764 | 45.864 |
| 4.446 | −2.7659 | 48.864 | 3.8455 | −1.4768 | 47.864 | 1.5753 | −0.5686 | 46.864 | 1.5794 | −0.3518 | 45.864 |
| 3.3195 | −1.7652 | 48.864 | 4.3134 | −2.5452 | 47.864 | 1.0805 | −0.1452 | 46.864 | 1.1165 | −0.146 | 45.864 |
| 4.3112 | −2.6155 | 48.864 | 5.1032 | −2.1533 | 47.864 | 2.1373 | −0.6315 | 46.864 | 1.068 | −0.2306 | 45.864 |
| 5.0256 | −3.5993 | 48.864 | 3.8459 | −2.1086 | 47.864 | 5.4902 | −2.3254 | 46.864 | 5.9539 | −2.5907 | 45.864 |
| 4.0005 | −2.3096 | 48.864 | 3.3366 | −1.7213 | 47.864 | 3.6895 | −1.9214 | 46.864 | 5.1024 | −2.0224 | 45.864 |
| 4.0975 | −1.6551 | 48.864 | 4.9141 | −3.3314 | 47.864 | 3.3437 | −1.1904 | 46.864 | 3.6632 | −1.8434 | 45.864 |
| 3.4953 | −1.8943 | 48.864 | 4.6924 | −3.0002 | 47.864 | 4.8526 | −3.1645 | 46.864 | 3.6639 | −1.2991 | 45.864 |
| 5.5054 | −2.4851 | 48.864 | 4.1007 | −1.6052 | 47.864 | 4.7719 | −1.9009 | 46.864 | 3.1348 | −1.4781 | 45.864 |
| 4.159 | −2.4594 | 48.864 | 2.779 | −1.349 | 47.864 | 4.1647 | −2.3276 | 46.864 | 5.7114 | −2.4052 | 45.864 |
| 4.9286 | −2.1153 | 48.864 | 5.3458 | −2.304 | 47.864 | 5.8112 | −2.5522 | 46.864 | 2.9542 | −1.363 | 45.864 |
| 4.5745 | −2.9216 | 48.864 | 3.6798 | −1.9747 | 47.864 | 3.3523 | −1.6762 | 46.864 | 4.5888 | −1.7476 | 45.864 |
| 3.6679 | −2.0276 | 48.864 | 6.1408 | −2.9171 | 47.864 | 3.9195 | −1.4655 | 46.864 | 4.5755 | −2.7126 | 45.864 |
| 3.7096 | −1.4558 | 48.864 | 5.109 | −3.6832 | 47.864 | 4.5989 | −2.8067 | 46.864 | 3.4899 | −1.7176 | 45.864 |
| 5.7805 | −2.6892 | 48.864 | 5.6774 | −2.5314 | 47.864 | 5.3246 | −2.2195 | 46.864 | 6.0694 | −2.6904 | 45.864 |
| 4.7063 | −1.9863 | 48.864 | 4.8564 | −2.0094 | 47.864 | 3.8527 | −2.051 | 46.864 | 5.0207 | −3.3928 | 45.864 |
| 3.8366 | −2.1658 | 48.864 | 4.446 | −2.6915 | 47.864 | 6.1121 | −2.8048 | 46.864 | 3.9969 | −2.1119 | 45.864 |
| 5.6443 | −2.5852 | 48.864 | 5.5133 | −2.4153 | 47.864 | 2.8045 | −1.3168 | 46.864 | 5.3096 | −2.1432 | 45.864 |
| 2.7531 | −1.3794 | 48.864 | 4.3545 | −1.7364 | 47.864 | 4.9663 | −3.3521 | 46.864 | 3.9739 | −1.4451 | 45.864 |
| 5.9134 | −2.7974 | 48.864 | 3.5098 | −1.8459 | 47.864 | 4.4899 | −1.7517 | 46.864 | 3.8325 | −1.9746 | 45.864 |
| 4.4819 | −1.8611 | 48.864 | 5.8375 | −2.6533 | 47.864 | 4.3119 | −2.4752 | 46.864 | 4.4451 | −2.5564 | 45.864 |
| 5.148 | −2.249 | 48.864 | 3.5892 | −1.3505 | 47.864 | 5.6526 | −2.436 | 46.864 | 3.3135 | −1.5961 | 45.864 |
| 4.812 | −3.2481 | 48.864 | 4.1635 | −2.3934 | 47.864 | 3.5224 | −1.7967 | 46.864 | 4.9213 | −3.2152 | 45.864 |
| 3.0384 | −1.5692 | 48.864 | 3.0598 | −1.5321 | 47.864 | 3.6321 | −1.327 | 46.864 | 5.8343 | −2.4958 | 45.864 |
| 3.3193 | −1.2611 | 48.864 | 3.3321 | −1.2259 | 47.864 | 4.7301 | −2.9826 | 46.864 | 4.3075 | −2.4065 | 45.864 |
| 6.0423 | −2.9103 | 48.864 | 4.5724 | −2.8433 | 47.864 | 5.0506 | −2.0562 | 46.864 | 4.8924 | −1.9065 | 45.864 |
| 6.3853 | −3.2657 | 48.864 | 4.6066 | −1.8708 | 47.864 | 4.0114 | −2.1863 | 46.864 | 4.6986 | −2.8747 | 45.864 |
| 6.8863 | −4.1088 | 48.864 | 4.0074 | −2.248 | 47.864 | 5.9648 | −2.6749 | 46.864 | 3.3529 | −1.1552 | 45.864 |
| 5.6222 | −5.5762 | 48.864 | 5.9924 | −2.7815 | 47.864 | 3.0803 | −1.4935 | 46.864 | 6.1801 | −2.7953 | 45.864 |
| 6.1665 | −3.0282 | 48.864 | 4.8057 | −3.162 | 47.864 | 5.0709 | −3.5449 | 46.864 | 5.513 | −2.2703 | 45.864 |
| 6.8212 | −3.955 | 48.864 | 5.0152 | −3.5053 | 47.864 | 4.2056 | −1.6068 | 46.864 | 5.1069 | −3.5642 | 45.864 |
| 5.2094 | −3.967 | 48.864 | 5.2738 | −4.05 | 47.864 | 4.4594 | −2.6375 | 46.864 | 4.2824 | −1.5942 | 45.864 |
| 6.7481 | −3.8051 | 48.864 | 5.6019 | −5.4386 | 47.864 | 6.2225 | −2.9127 | 46.864 | 4.8139 | −3.0424 | 45.864 |

TABLE 1-continued

| | | | | | | | | | | | |
|---|---|---|---|---|---|---|---|---|---|---|---|
| 5.2897 | −4.1563 | 48.864 | 6.4575 | −3.2692 | 47.864 | 5.5817 | −6.1341 | 46.864 | 4.1555 | −2.2557 | 45.864 |
| 7.0698 | −4.7496 | 48.864 | 6.6356 | −3.53 | 47.864 | 6.6798 | −3.5375 | 46.864 | 5.5717 | −5.7624 | 45.864 |
| 5.1213 | −3.7813 | 48.864 | 7.0566 | −4.8205 | 47.864 | 5.5521 | −5.094 | 46.864 | 6.9788 | −5.1485 | 45.864 |
| 7.1247 | −5.1126 | 48.864 | 6.2521 | −3.0292 | 47.864 | 6.9423 | −4.2882 | 46.864 | 6.9078 | −4.2438 | 45.864 |
| 6.9434 | −4.2656 | 48.864 | 6.3579 | −3.1466 | 47.864 | 5.3213 | −4.1282 | 46.864 | 5.5702 | −5.5483 | 45.864 |
| 5.601 | −5.3592 | 48.864 | 5.463 | −4.6226 | 47.864 | 6.4262 | −3.1447 | 46.864 | 6.6918 | −3.5247 | 45.864 |
| 5.6261 | −6.2298 | 48.864 | 5.58 | −5.2265 | 47.864 | 5.5942 | −5.7175 | 46.864 | 5.2573 | −3.9171 | 45.864 |
| 7.1009 | −4.9306 | 48.864 | 5.6114 | −6.0779 | 47.864 | 6.8094 | −3.8289 | 46.864 | 6.2853 | −2.9059 | 45.864 |
| 5.6334 | −5.794 | 48.864 | 6.8491 | −3.97 | 47.864 | 5.4825 | −4.6951 | 46.864 | 5.5421 | −5.121 | 45.864 |
| 5.6345 | −6.012 | 48.864 | 6.7864 | −3.8192 | 47.864 | 7.0035 | −4.6621 | 46.864 | 6.9696 | −4.7852 | 45.864 |
| 5.4266 | −4.5439 | 48.864 | 5.6143 | −5.6515 | 47.864 | 5.1662 | −3.7424 | 46.864 | 6.8365 | −3.9275 | 45.864 |
| 6.2786 | −3.1444 | 48.864 | 7.0221 | −4.5987 | 47.864 | 5.5647 | −6.3527 | 46.864 | 6.5589 | −3.2723 | 45.864 |
| 5.5696 | −5.1435 | 48.864 | 6.5502 | −3.3971 | 47.864 | 6.6018 | −3.3984 | 46.864 | 5.5657 | −5.9765 | 45.864 |
| 6.6666 | −3.6596 | 48.864 | 5.1952 | −3.8649 | 47.864 | 5.5748 | −5.3012 | 46.864 | 5.5148 | −4.9086 | 45.864 |
| 5.3621 | −4.3487 | 48.864 | 5.5975 | −6.2907 | 47.864 | 6.9056 | −4.133 | 46.864 | 5.1857 | −3.7391 | 45.864 |
| 6.4859 | −3.3921 | 48.864 | 5.3447 | −4.2382 | 47.864 | 5.3828 | −4.3149 | 46.864 | 6.9356 | −4.4235 | 45.864 |
| 5.5307 | −4.9416 | 48.864 | 6.9503 | −4.2803 | 47.864 | 7.0362 | −5.0995 | 46.864 | 5.5535 | −6.1806 | 45.864 |
| 6.5799 | −3.5234 | 48.864 | 7.0803 | −5.0437 | 47.864 | 6.3275 | −3.0259 | 46.864 | 6.747 | −3.6564 | 45.864 |
| 5.4829 | −4.7417 | 48.864 | 5.51 | −4.8181 | 47.864 | 5.5916 | −5.9259 | 46.864 | 6.384 | −3.0223 | 45.864 |
| 6.9927 | −4.425 | 48.864 | 5.4078 | −4.4292 | 47.864 | 6.7489 | −3.6812 | 46.864 | 6.9771 | −4.9668 | 45.864 |
| 7.0347 | −4.5865 | 48.864 | 6.9897 | −4.4387 | 47.864 | 5.5205 | −4.8879 | 46.864 | 6.8716 | −4.0658 | 45.864 |
| 7.1529 | −5.8568 | 48.864 | 6.7153 | −3.6724 | 47.864 | 6.9723 | −4.4449 | 46.864 | 5.3783 | −4.2812 | 45.864 |
| 7.1429 | −6.0513 | 48.864 | 5.6173 | −5.8648 | 47.864 | 5.2522 | −3.9442 | 46.864 | 6.6291 | −3.3965 | 45.864 |
| 7.1416 | −5.2954 | 48.864 | 6.9036 | −4.1239 | 47.864 | 6.5178 | −3.2689 | 46.864 | 5.3215 | −4.0979 | 45.864 |
| 7.1557 | −5.6622 | 48.864 | 5.5485 | −5.0155 | 47.864 | 5.5888 | −5.5091 | 46.864 | 5.5605 | −5.3344 | 45.864 |
| 6.9476 | −7.0709 | 48.864 | 6.9033 | −6.8722 | 47.864 | 6.8614 | −3.9797 | 46.864 | 6.9559 | −4.6041 | 45.864 |
| 5.5116 | −7.6373 | 48.864 | 5.5071 | −7.4046 | 47.864 | 5.4365 | −4.504 | 46.864 | 6.7951 | −3.7908 | 45.864 |
| 6.9878 | −6.9462 | 48.864 | 7.0134 | −6.4395 | 47.864 | 7.0246 | −4.8804 | 46.864 | 5.5369 | −6.3843 | 45.864 |
| 6.4677 | −7.8773 | 48.864 | 5.5043 | −7.2104 | 47.864 | 6.8441 | −6.7092 | 46.864 | 5.433 | −4.4883 | 45.864 |
| 6.066 | −8.1055 | 48.864 | 7.0854 | −5.8728 | 47.864 | 5.5053 | −7.0343 | 46.864 | 6.4754 | −3.1446 | 45.864 |
| 5.5058 | −7.5763 | 48.864 | 5.5032 | −7.3361 | 47.864 | 6.5551 | −7.3194 | 46.864 | 5.4785 | −4.6976 | 45.864 |
| 6.5985 | −7.7336 | 48.864 | 5.7573 | −7.8562 | 47.864 | 6.2584 | −7.62 | 46.864 | 6.6956 | −6.7886 | 45.864 |
| 6.3947 | −7.9415 | 48.864 | 6.6989 | −7.3414 | 47.864 | 5.9443 | −7.7118 | 46.864 | 6.0056 | −7.5103 | 45.864 |
| 7.1254 | −6.2452 | 48.864 | 6.4527 | −7.6721 | 47.864 | 7.0392 | −5.3188 | 46.864 | 6.8869 | −6.1359 | 45.864 |
| 5.5353 | −7.7576 | 48.864 | 7.0688 | −6.0625 | 47.864 | 5.666 | −7.5853 | 46.864 | 5.5136 | −7.0614 | 45.864 |
| 5.6128 | −7.9233 | 48.864 | 5.8757 | −7.9027 | 47.864 | 6.958 | −6.2449 | 46.864 | 6.2514 | −7.4136 | 45.864 |
| 5.6986 | −8.0156 | 48.864 | 5.7042 | −7.8208 | 47.864 | 5.5199 | −7.2903 | 46.864 | 5.5191 | −6.588 | 45.864 |
| 5.8721 | −8.1024 | 48.864 | 5.5153 | −7.4726 | 47.864 | 6.7412 | −6.9827 | 46.864 | 6.5258 | −7.1144 | 45.864 |
| 5.5271 | −7.1305 | 48.864 | 7.0941 | −5.2678 | 47.864 | 5.5212 | −6.7892 | 46.864 | 6.7883 | −6.5324 | 45.864 |
| 5.5039 | −7.4186 | 48.864 | 5.5498 | −6.7369 | 47.864 | 6.4391 | −7.4646 | 46.864 | 6.9402 | −5.7895 | 45.864 |
| 6.2008 | −8.0626 | 48.864 | 5.549 | −7.6053 | 47.864 | 6.1278 | −7.6851 | 46.864 | 5.5313 | −7.1496 | 45.864 |
| 6.793 | −7.432 | 48.864 | 6.9731 | −6.6256 | 47.864 | 5.823 | −7.6846 | 46.864 | 5.7189 | −7.4284 | 45.864 |
| 5.6094 | −6.4472 | 48.864 | 6.0653 | −7.904 | 47.864 | 7.0257 | −5.6907 | 46.864 | 6.362 | −7.3196 | 45.864 |
| 5.5557 | −6.9029 | 48.864 | 7.0985 | −5.4922 | 47.864 | 5.5848 | −7.4794 | 46.864 | 5.8267 | −7.4847 | 45.864 |
| 5.5549 | −7.8156 | 48.864 | 5.9386 | −7.9124 | 47.864 | 6.8854 | −6.569 | 46.864 | 6.6394 | −6.9127 | 45.864 |
| 7.0662 | −6.6301 | 48.864 | 6.5171 | −7.6023 | 47.864 | 5.5058 | −7.1571 | 46.864 | 5.9451 | −7.5109 | 45.864 |
| 5.8101 | −8.0824 | 48.864 | 6.7592 | −7.2284 | 47.864 | 6.6061 | −7.2416 | 46.864 | 6.8588 | −6.2692 | 45.864 |
| 6.1293 | −8.0896 | 48.864 | 5.6567 | −7.7785 | 47.864 | 6.3178 | −7.5776 | 46.864 | 6.9738 | −5.3626 | 45.864 |
| 5.9364 | −8.1129 | 48.864 | 6.6315 | −7.4504 | 47.864 | 6.0063 | −7.7116 | 46.864 | 5.5052 | −6.9718 | 45.864 |
| 7.1518 | −5.4787 | 48.864 | 5.5122 | −7.085 | 47.864 | 5.7136 | −7.6254 | 46.864 | 6.1897 | −7.4521 | 45.864 |
| 5.5092 | −7.3224 | 48.864 | 6.813 | −7.1121 | 47.864 | 6.9874 | −6.061 | 46.864 | 5.584 | −7.2802 | 45.864 |
| 5.6512 | −7.971 | 48.864 | 6.5766 | −7.5281 | 47.864 | 5.5347 | −7.3557 | 46.864 | 6.4713 | −7.1925 | 45.864 |
| 6.9021 | −7.1938 | 48.864 | 6.3245 | −7.7831 | 47.864 | 6.7963 | −6.8474 | 46.864 | 6.745 | −6.6616 | 45.864 |
| 6.3335 | −7.9872 | 48.864 | 7.0953 | −5.6826 | 47.864 | 5.5115 | −6.9116 | 46.864 | 6.0656 | −7.5004 | 45.864 |
| 6.0014 | −8.1137 | 48.864 | 6.3831 | −7.7368 | 47.864 | 6.4996 | −7.394 | 46.864 | 6.9107 | −6.0017 | 45.864 |
| 6.2689 | −8.028 | 48.864 | 6.9405 | −6.7496 | 47.864 | 6.195 | −7.6564 | 46.864 | 5.8851 | −7.5021 | 45.864 |
| 5.5031 | −7.515 | 48.864 | 6.127 | −7.8875 | 47.864 | 5.8828 | −7.7026 | 46.864 | 5.5056 | −6.792 | 45.864 |
| 5.5806 | −7.8712 | 48.864 | 6.1964 | −7.8598 | 47.864 | 7.0354 | −5.5049 | 46.864 | 5.5534 | −7.2167 | 45.864 |
| 6.7286 | −7.5461 | 48.864 | 5.8148 | −7.8838 | 47.864 | 5.6216 | −7.5353 | 46.864 | 6.3088 | −7.369 | 45.864 |
| 7.1 | −6.4383 | 48.864 | 5.6128 | −7.726 | 47.864 | 6.9208 | −6.4272 | 46.864 | 5.6236 | −7.3386 | 45.864 |
| 5.5849 | −6.6753 | 48.864 | 5.576 | −6.5141 | 47.864 | 5.5107 | −7.224 | 46.864 | 6.5755 | −7.0331 | 45.864 |
| 5.5171 | −7.2264 | 48.864 | 6.8609 | −6.9932 | 47.864 | 6.6781 | −7.1145 | 46.864 | 6.826 | −6.4014 | 45.864 |
| 7.0228 | −6.8199 | 48.864 | 5.5289 | −7.5398 | 47.864 | 5.543 | −6.571 | 46.864 | 6.9611 | −5.5763 | 45.864 |
| 6.8507 | −7.3143 | 48.864 | 7.0449 | −6.2516 | 47.864 | 6.3734 | −7.5303 | 46.864 | 5.5032 | −6.8819 | 45.864 |
| 6.6568 | −7.6557 | 48.864 | 6.0022 | −7.9126 | 47.864 | 6.0679 | −7.7023 | 46.864 | 5.6716 | −7.3903 | 45.864 |
| 5.7519 | −8.0531 | 48.864 | 6.2623 | −7.8245 | 47.864 | 5.7663 | −7.6587 | 46.864 | 6.1238 | −7.4825 | 45.864 |
| 6.5356 | −7.8078 | 48.864 | 5.5238 | −6.9598 | 47.864 | 7.0097 | −5.8762 | 46.864 | 6.4116 | −7.2665 | 45.864 |
| 5.5212 | −7.6979 | 48.864 | 5.5768 | −7.6678 | 47.864 | 5.556 | −7.4191 | 46.864 | 5.7709 | −7.46 | 45.864 |

At this point it should be understood that the points disclosed in Table 1 are exemplary, variations/deviations from the points in Table 1 at one or more sections that do not substantially affect the desired properties obtained by the airfoil core shape of the exemplary embodiments fall within the scope of the exemplary embodiments of the invention.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine component comprising:

a turbine stator nozzle member having an airfoil core shape, the airfoil core shape having a nominal profile substantially in accordance with Cartesian coordinate values of X, Y, and Z set forth in TABLE 1, and wherein X and Y are distances in inches which, when connected by smooth continuing arcs, define airfoil profile sections at each distance Z in inches, the profile sections at the Z distances being joined smoothly with one another to form a complete airfoil core shape.

2. The turbomachine component according to claim 1, wherein the turbine stator nozzle member includes a first end that extends to a second end through an airfoil portion, the airfoil core shape defining the airfoil portion.

3. The turbomachine component according to claim 1, wherein the turbine stator nozzle member forms part of a nozzle assembly.

4. The turbomachine component according to claim 1, wherein turbine stator nozzle member comprises a third stage nozzle member.

5. The turbomachine component according to claim 1, wherein the nominal profile lies within an envelope within +0.100 inches and −0.1000 inches in a direction normal to any of the airfoil profile sections.

6. A turbomachine comprising:

a turbine portion; and a turbine stator nozzle member provided in the turbine portion, the turbine stator nozzle member having an airfoil core shape, the airfoil core shape having a nominal profile substantially in accordance with Cartesian coordinate values of X, Y, and Z set forth in TABLE 1, and wherein X and Y are distances in inches which, when connected by smooth continuing arcs, define airfoil profile sections at each distance Z in inches, the profile sections at the Z distances being joined smoothly with one another to form a complete airfoil core shape.

7. The turbomachine according to claim 6, wherein the turbine stator nozzle member includes a first end that extends to a second end through an airfoil portion, the airfoil core shape defining the airfoil portion.

8. The turbomachine according to claim 7, wherein the turbine stator nozzle member forms part of a nozzle assembly.

9. The turbomachine according to claim 8, wherein the turbine stator nozzle member comprises a third stage nozzle member.

10. The turbomachine according to claim 6, wherein the nominal profile lies within an envelope within +0.100 inches and −0.100 inches in a direction normal to any of the airfoil profile sections.

* * * * *